US009826824B2

(12) United States Patent
Lim et al.

(10) Patent No.: US 9,826,824 B2
(45) Date of Patent: Nov. 28, 2017

(54) COSMETIC BRUSH CLEANING AID

(71) Applicant: HCT Group Holdings Limited, Santa Monica, CA (US)

(72) Inventors: Cindy Sean Yuei Lim, Santa Monica, CA (US); Michelle Wong, Alhambra, CA (US); Nadine Yiang, Playa Del Ray, CA (US)

(73) Assignee: HCT GROUP HOLDINGS LIMITED, Santa Monica, CA (US)

( * ) Notice: Subject to any disclaimer, the term of this patent is extended or adjusted under 35 U.S.C. 154(b) by 251 days.

(21) Appl. No.: 14/522,104

(22) Filed: Oct. 23, 2014

(65) Prior Publication Data

US 2016/0113386 A1 Apr. 28, 2016

(51) Int. Cl.
*A46B 17/06* (2006.01)
*A46B 9/02* (2006.01)

(52) U.S. Cl.
CPC ..... *A46B 17/06* (2013.01); *A46B 9/021* (2013.01)

(58) Field of Classification Search
CPC ..... A46B 17/06; A46B 9/021
See application file for complete search history.

(56) References Cited

U.S. PATENT DOCUMENTS 544,452 A 8/1895 Young et al.
D27,690 S 9/1897 Waite
715,881 A 12/1902 Scott
783,937 A 2/1905 Edwards et al.
(Continued)

FOREIGN PATENT DOCUMENTS

CN 1196212 A 10/1998
CN 201192160 Y 2/2009
(Continued)

OTHER PUBLICATIONS

"All for One, Full Magnetic Travel Brush Set", Sephora, retrieved on Feb. 26, 2015 at http://www.sephora.com/aa-for-one-full-magnetic-travel-brush-set-P387815>>, 3 pages.
(Continued)

*Primary Examiner* — Shay Karls
(74) *Attorney, Agent, or Firm* — Seager, Tufte & Wickhem LLP.

(57) ABSTRACT

A cosmetic brush cleaning apparatus and processes for streamlining cleaning, drying, and/or storing cosmetic brushes are described. The cosmetic brush cleaning apparatus may include elevated elements to aid in cleaning and drawing out make-up, dirt, debris, etc., in the fibrous heads of cosmetic brushes. The cosmetic brush cleaning apparatus may include draining mechanisms for removing excess water resulting from the cleaning process. The cosmetic brush cleaning apparatus may include an elevated wall that follows a contour of the cosmetic brush cleaning apparatus for retaining water within the elevated wall of the cosmetic cleaning apparatus and/or securing cosmetic brushes for drying and storing cosmetic brushes. The cosmetic brush cleaning apparatus may include one or more additional drying elements for drying and/or storing the cosmetic brushes. The cosmetic brush cleaning system enables users to deep clean cosmetic brushes efficiently and conveniently dry and/or store the cosmetic brushes.

19 Claims, 10 Drawing Sheets

(56) References Cited

U.S. PATENT DOCUMENTS 987,277 A 3/1911 Wright
1,142,698 A 6/1915 Grove et al.
1,185,617 A 6/1916 Blaha et al.
1,190,227 A 7/1916 Fesler
1,242,956 A 10/1917 Lewyt
1,261,502 A 4/1918 Farrows
1,355,026 A 10/1920 Austin
1,429,823 A 9/1922 Allison
1,457,615 A 6/1923 Bunker
1,480,814 A 1/1924 Bright et al.
1,486,957 A 3/1924 England
1,501,835 A 7/1924 Bash
1,508,306 A 9/1924 Strulson
1,510,898 A 10/1924 Nikicser
1,527,052 A 2/1925 McAndrews
1,563,031 A 11/1925 Jones
1,586,332 A 5/1926 Vinton
1,651,355 A 12/1927 Alland
1,666,116 A 4/1928 Bunnell
1,748,491 A 2/1930 May
1,748,895 A 2/1930 Jordan
1,831,393 A 11/1931 Pierce, Jr.
1,864,874 A 6/1932 Voight
1,889,496 A 11/1932 Priest
1,899,242 A 2/1933 Mcnab
1,914,240 A 6/1933 Caldwell
1,938,442 A 12/1933 Stuart
1,972,532 A 9/1934 McMillan
2,104,651 A 1/1938 Hoffman, Jr.
2,132,943 A 10/1938 Frazier
2,141,531 A 12/1938 Graham
2,199,154 A 4/1940 Frohnert
2,262,753 A 11/1941 Brennan
D134,797 S 1/1943 Lubkin
2,442,051 A 5/1948 Luscri
2,485,822 A 10/1949 Goldrich
2,533,838 A 12/1950 Ranft
D165,691 S 1/1952 Macomic
2,584,735 A 2/1952 Pancoast
2,590,329 A 3/1952 Kromray
2,591,537 A 4/1952 Gordon
2,622,256 A 12/1952 Vojacek
2,637,060 A 5/1953 Cowan
2,637,868 A 5/1953 Hamilton
2,642,331 A 6/1953 Sprinkle
2,701,378 A 2/1955 Reinbolt et al.
2,736,051 A 2/1956 Boodakian
2,797,886 A 7/1957 Pinckney
2,874,399 A 2/1959 Solomon
2,946,072 A 7/1960 Filler et al.
2,982,983 A 5/1961 Peterson
2,997,210 A 8/1961 Mackirdy
3,007,188 A 11/1961 Dolan
3,106,738 A 10/1963 Bohne
3,170,265 A 2/1965 Goldfarb
3,193,863 A 7/1965 Myers et al.
3,205,523 A 9/1965 Seaver
D205,127 S 6/1966 Dykes
3,291,130 A 12/1966 Whitehead
3,309,728 A 3/1967 Seaver
3,353,203 A 11/1967 Ginter
3,472,242 A 10/1969 Demner
3,495,858 A 2/1970 Kindel
3,505,700 A 4/1970 Rodriguez
3,531,814 A 10/1970 Safalow
3,577,582 A 5/1971 Aston
3,592,202 A 7/1971 Jones
3,712,749 A 1/1973 Roberts
3,867,299 A 2/1975 Rohatgi et al.
3,884,635 A 5/1975 Sloan et al.
3,908,676 A 9/1975 Levine et al.
3,951,157 A 4/1976 Idec
3,955,670 A 5/1976 Buslik et al.
4,088,413 A 5/1978 Rossignol de la Ronde et al.
D249,600 S 9/1978 Bowman
4,129,918 A 12/1978 Lee et al.
D251,159 S 2/1979 Tolliver
4,140,222 A 2/1979 Francavilla
4,165,942 A 8/1979 Johansson
4,187,607 A 2/1980 Simuro et al.
4,203,431 A 5/1980 Abura
4,204,294 A 5/1980 Halverson
4,213,472 A 7/1980 Gueret et al.
D258,241 S 2/1981 Takada et al.
4,248,543 A 2/1981 Carrington et al.
4,267,851 A 5/1981 Plaisted
4,280,729 A * 7/1981 Morawski ..... B60N 3/044 15/215
4,292,986 A 10/1981 Ergaver et al.
4,381,159 A 4/1983 Payne
D269,481 S 6/1983 Souza
4,396,238 A 8/1983 Torruella et al.
4,479,047 A 10/1984 Khaja et al.
4,483,036 A 11/1984 Sayklay
4,502,497 A 3/1985 Siahou et al.
D278,951 S 5/1985 Kalinsky
4,545,393 A 10/1985 Gueret et al.
4,600,328 A 7/1986 Clements
4,617,948 A 10/1986 Gueret
4,681,791 A 7/1987 Shibahashi et al.
4,727,618 A 3/1988 Mahoney et al.
4,734,953 A 4/1988 Dodson
D296,005 S 5/1988 Alkire
D297,889 S 10/1988 Ries et al.
4,776,456 A 10/1988 Lewis
4,778,300 A 10/1988 French et al.
4,869,612 A 9/1989 Mooney et al.
4,898,193 A 2/1990 Gueret et al.
4,917,132 A 4/1990 Tuchman
4,929,108 A 5/1990 Gueret
D311,455 S 10/1990 Snipes
4,987,911 A 1/1991 Powers
5,007,442 A 4/1991 Hirzel et al.
5,052,839 A 10/1991 Pettengill
5,056,179 A 10/1991 Capponi
D325,264 S 4/1992 Shinohara
5,107,984 A 4/1992 Welschoff
5,109,877 A 5/1992 Takeda
D328,366 S 7/1992 Villani
5,134,747 A 8/1992 Roesler et al.
5,137,038 A 8/1992 Kingsford
5,153,066 A 10/1992 Tanaka et al.
5,176,754 A 1/1993 Hirzel
5,211,494 A 5/1993 Baijnath et al.
5,220,702 A 6/1993 Howell et al.
D339,235 S 9/1993 Hirzel
5,301,695 A 4/1994 Wong
5,316,513 A 5/1994 Nakagawa et al.
5,330,056 A 7/1994 De La Rocha
5,333,343 A 8/1994 Nichols et al.
5,334,421 A 8/1994 McNutt
5,339,483 A 8/1994 Byun et al.
5,348,031 A 9/1994 Cloud
5,388,599 A 2/1995 Yen et al.
5,431,176 A 7/1995 Favre et al.
5,447,167 A 9/1995 Fleischaker
5,480,027 A 1/1996 Leonard
5,480,038 A 1/1996 Collier
5,482,059 A 1/1996 Miraglia
5,484,065 A 1/1996 Davoli
5,491,865 A 2/1996 Gueret
5,507,063 A 4/1996 Hirsch
5,535,474 A 7/1996 Salazar
5,573,019 A 11/1996 Hempel
5,588,447 A 12/1996 Gueret
D377,121 S 1/1997 Lee
5,596,785 A 1/1997 Park
5,603,340 A 2/1997 Gueret
5,617,884 A 4/1997 Allison
5,620,270 A 4/1997 Gueret
5,628,082 A 5/1997 Moskovich et al.
5,630,505 A 5/1997 Garcia
D380,615 S 7/1997 Roberts
5,713,471 A 2/1998 Gueret

(56) References Cited

U.S. PATENT DOCUMENTS 5,765,252 A 6/1998 Carr
5,778,479 A 7/1998 Raia
5,799,910 A 9/1998 Dexter et al.
5,802,658 A 9/1998 Ward
5,839,626 A 11/1998 Gross et al.
5,881,742 A 3/1999 Hunsberger
D408,636 S 4/1999 Gadling
5,896,614 A 4/1999 Flewitt et al.
5,896,866 A 4/1999 Quennessen
5,941,254 A 8/1999 Heler
5,957,604 A 9/1999 Anderson
5,960,745 A 10/1999 Boyland
5,960,802 A 10/1999 Sakai
5,970,989 A 10/1999 Litton et al.
5,974,618 A 11/1999 Dumler et al.
5,976,616 A 11/1999 Celia
5,987,686 A * 11/1999 Lane ..... A46B 17/06 15/142
6,024,101 A 2/2000 Garner et al.
6,026,824 A 2/2000 Gueret
D421,846 S 3/2000 Choe
6,039,051 A 3/2000 Dorf
D422,916 S 4/2000 Herrmann
6,070,597 A 6/2000 Motherhead
6,070,749 A 6/2000 Joulia
6,074,076 A 6/2000 Parrish
6,119,891 A 9/2000 Favre
6,138,686 A 10/2000 Yuhara
6,145,151 A 11/2000 Herron et al.
6,158,443 A 12/2000 Leman et al.
6,173,719 B1 1/2001 Petit
6,180,741 B1 1/2001 Yamaguchi et al.
6,186,324 B1 2/2001 Catterson
6,189,697 B1 2/2001 Davis
D439,415 S 3/2001 Mink et al.
6,199,694 B1 3/2001 Van Diest et al.
6,202,242 B1 3/2001 Salmon et al.
6,202,902 B1 3/2001 Starr
6,224,287 B1 5/2001 Gieux
6,234,181 B1 5/2001 Lou
6,241,203 B1 6/2001 Cukrov
6,254,996 B1 7/2001 Fukuda et al.
6,264,147 B1 7/2001 Mitchell
6,268,040 B1 7/2001 McArthur
6,269,515 B1 8/2001 Varma
D448,178 S 9/2001 Tapley et al.
6,283,298 B1 9/2001 Seidler
6,298,863 B1 10/2001 Byun
6,309,124 B1 10/2001 Gueret
D450,189 S 11/2001 Mink et al.
D450,930 S 11/2001 Mink et al.
D450,931 S 11/2001 Mink et al.
6,311,358 B1 11/2001 Soetewey et al.
6,312,182 B1 11/2001 Dumler
D451,681 S 12/2001 Mink et al.
6,336,460 B2 1/2002 Yuhara
6,338,406 B1 * 1/2002 Zagar ..... A46B 17/04 206/15.3
6,342,167 B1 1/2002 Kawano et al.
D454,001 S 3/2002 Mink et al.
6,354,308 B1 3/2002 Kuk
6,357,944 B1 3/2002 Reed et al.
6,371,420 B1 4/2002 Strunk
D458,134 S 6/2002 Berish et al.
6,401,290 B1 6/2002 Barton et al.
6,405,402 B1 6/2002 Choi
6,418,939 B1 7/2002 Byun
6,438,784 B1 8/2002 Yu
6,497,236 B1 12/2002 Yates et al.
6,505,402 B2 1/2003 Moriwake et al.
6,506,327 B2 1/2003 Weihrauch
D471,018 S 3/2003 Mink
6,532,970 B2 3/2003 Phue
D472,462 S 4/2003 Atkin et al.
6,546,937 B2 4/2003 Gueret
D474,342 S 5/2003 Silvestri
D475,536 S 6/2003 Vaes
6,588,958 B1 7/2003 Seidler
6,596,203 B1 7/2003 Au et al.
6,601,591 B1 8/2003 Carullo et al.
D479,917 S 9/2003 Mink
D479,918 S 9/2003 Mink
D480,218 S 10/2003 Mink
6,669,389 B2 12/2003 Gueret
D485,442 S 1/2004 Twigg
6,706,775 B2 3/2004 Hermann et al.
6,712,076 B2 3/2004 Alexander et al.
6,761,969 B2 7/2004 Li et al.
6,831,541 B1 12/2004 Seidler
6,832,405 B1 12/2004 Miller
6,866,046 B2 3/2005 Gueret
6,880,197 B2 4/2005 Katz et al.
6,890,115 B2 5/2005 Le Moing
6,895,628 B1 5/2005 Anderson
6,898,818 B2 5/2005 Lin
6,942,412 B2 9/2005 Gueret
6,957,468 B2 10/2005 Driesen et al.
7,004,913 B1 2/2006 Rutenberg et al.
7,007,797 B1 3/2006 Ruccolo
7,073,902 B2 7/2006 Codos et al.
7,096,598 B1 8/2006 Myatt
D527,529 S 9/2006 Ajluni et al.
D528,305 S 9/2006 Langer
7,107,645 B2 9/2006 Bressler et al.
7,111,354 B2 9/2006 Nennig et al.
D529,292 S 10/2006 Langer
7,127,770 B2 10/2006 Clegg et al.
7,140,061 B2 11/2006 Baker et al.
7,159,950 B2 1/2007 Young-Chul
7,228,864 B2 6/2007 Tahara
7,234,474 B2 6/2007 Byun
7,246,400 B2 7/2007 Ryan
7,261,483 B2 8/2007 Gueret
D549,964 S 9/2007 Roth et al.
D550,562 S 9/2007 Yew
D551,569 S 9/2007 Tanaka
7,275,885 B2 10/2007 Byun
7,316,045 B2 1/2008 Koke
D562,005 S 2/2008 King
D562,566 S 2/2008 Mink
7,334,685 B2 2/2008 Mathiez
7,337,787 B2 3/2008 Matsuoka
7,344,327 B2 3/2008 Gueret
D566,969 S 4/2008 Sherman et al.
D568,050 S 5/2008 Huang
D568,740 S 5/2008 Williams
D571,105 S 6/2008 Godin
D572,585 S 7/2008 Perrin et al.
7,416,358 B2 8/2008 Legendre
D577,911 S 10/2008 Liebers
D578,773 S 10/2008 Sherman et al.
D580,177 S 11/2008 Louis-Jeune
7,448,111 B2 11/2008 Bigio
7,465,113 B2 12/2008 Gueret
D584,513 S 1/2009 Sherman et al.
D584,897 S 1/2009 Belley
7,494,030 B2 2/2009 Bennett
D589,665 S 3/2009 Kwapis
7,530,752 B2 5/2009 Gueret
D598,655 S 8/2009 Thorpe et al.
7,581,544 B2 9/2009 Gueret
D601,803 S 10/2009 Reishus et al.
D601,804 S 10/2009 Hwang
7,653,960 B2 2/2010 Lee
D612,615 S 3/2010 Chitayat et al.
7,716,775 B2 5/2010 DiPietro et al.
D616,743 S 6/2010 Cresswell et al.
D616,744 S 6/2010 Cresswell et al.
7,727,634 B2 6/2010 Yacovone
D620,798 S 8/2010 Cresswell et al.
D621,258 S 8/2010 Gullickson et al.
7,766,440 B2 8/2010 Kusunoki
D623,371 S 9/2010 Li
D626,338 S 11/2010 Ajootian

(56) References Cited

U.S. PATENT DOCUMENTS 7,824,124 B2 11/2010 Francavilla et al.
7,832,564 B2 11/2010 Kim
7,854,562 B2 12/2010 Peterson et al.
7,866,758 B2 1/2011 Jang
D632,488 S 2/2011 Twigg
7,882,949 B1 2/2011 Singh
7,895,696 B2 3/2011 Belmonte
7,895,698 B2 3/2011 Mink
7,918,620 B2 4/2011 Del Ponte
D637,404 S 5/2011 Wang
7,950,402 B1 5/2011 Cole
7,955,014 B2 6/2011 Thorpe et al.
7,996,947 B2 8/2011 Gueret
D646,487 S 10/2011 Leppla et al.
8,032,972 B2 10/2011 Cherry
8,061,518 B2 11/2011 Shaughness
8,074,666 B2 12/2011 Piao
8,074,796 B1 12/2011 Andrews
D651,409 S 1/2012 Papenfu
8,104,132 B2 1/2012 Mink
D654,375 S 2/2012 Kuboshima
8,117,707 B1 2/2012 Ruh, II
8,132,285 B2 3/2012 Piao
8,132,541 B1 3/2012 Baer, Jr.
8,136,536 B2 3/2012 Bickford
8,141,561 B2 3/2012 Thorpe et al.
D658,385 S 5/2012 Lim et al.
D658,389 S 5/2012 Salgatar
8,184,998 B2 5/2012 Morikuni
8,185,993 B2 5/2012 Fischer et al.
8,185,998 B2 5/2012 Xu
8,220,100 B2 7/2012 Diamond
8,220,469 B1 7/2012 Spagnuolo
8,226,319 B2 7/2012 Francavilla et al.
8,230,543 B2 7/2012 Shrier et al.
8,256,058 B2 9/2012 Telwar
D669,213 S 10/2012 Celia
8,286,790 B1 10/2012 McBryar
8,292,529 B2 10/2012 Francavilla
8,321,987 B2 12/2012 Bagley
8,360,078 B2 1/2013 Lim et al.
D675,829 S 2/2013 Jakubow
8,371,549 B1 2/2013 Paquette
8,393,037 B2 3/2013 Iwahori et al.
8,402,592 B2 3/2013 Byrne et al.
D681,342 S 5/2013 Brower
8,464,868 B2 * 6/2013 Kruger ..... A47B 88/90 206/361
8,522,973 B2 9/2013 Joseph
8,595,886 B2 12/2013 Edelstein et al.
8,657,107 B2 2/2014 Gabbard
8,678,693 B2 3/2014 Sturgis et al.
D707,390 S 6/2014 Bunkley
8,752,559 B1 6/2014 Tsai
D717,548 S 11/2014 Lim
D727,034 S 4/2015 Lewis
D727,567 S 4/2015 Bunkley
9,492,050 B2 11/2016 Filho et al.
2001/0003600 A1 6/2001 Guay
2002/0040720 A1 4/2002 Byun
2002/0078902 A1 6/2002 Ehrmann
2002/0148058 A1 10/2002 Greenwood et al.
2002/0162565 A1 11/2002 Sebban
2002/0164192 A1 11/2002 Gueret
2003/0005533 A1 1/2003 Woodnorth et al.
2003/0035953 A1 2/2003 Weihrauch
2003/0066151 A1 4/2003 Chang
2003/0089673 A1 5/2003 Herren
2003/0110585 A1 6/2003 Rechelbacher
2003/0135945 A1 7/2003 Nordstrom
2004/0050732 A1 3/2004 Baker
2004/0129580 A1 7/2004 Cochran
2004/0134009 A1 7/2004 Sander et al.
2004/0163193 A1 8/2004 Stafford
2004/0237996 A1 12/2004 Fischer
2005/0011030 A1 1/2005 Gonzalez
2005/0138747 A1 6/2005 Su et al.
2005/0198759 A1 9/2005 Segrea
2005/0249539 A1 11/2005 Habatjou
2005/0273962 A1 12/2005 Dillon
2006/0000729 A1 1/2006 Ceballos
2006/0075570 A1 4/2006 Gelfand
2006/0150355 A1 7/2006 Mason et al.
2006/0162736 A1 7/2006 Gray
2006/0223024 A1 10/2006 Hochman
2006/0260078 A1 11/2006 Ranks
2007/0080094 A1 4/2007 Moon
2007/0113364 A1 5/2007 Zen
2007/0124882 A1 6/2007 Lee
2007/0151061 A1 7/2007 Mink et al.
2007/0151571 A1 7/2007 Byun
2007/0206986 A1 9/2007 Gueret
2007/0261710 A1 11/2007 Son et al.
2007/0295351 A1 12/2007 Germer
2008/0060665 A1 3/2008 Umeno et al.
2008/0073300 A1 * 3/2008 Abraitis ..... A47B 61/04 211/36
2008/0078419 A1 4/2008 Hirst
2008/0213719 A1 9/2008 Giniger et al.
2008/0243179 A1 10/2008 Ziv
2008/0256725 A1 10/2008 Emge
2008/0256733 A1 10/2008 Brown
2008/0276396 A1 11/2008 Lucero
2008/0309017 A1 12/2008 Mattice
2009/0003917 A1 1/2009 Duncan
2009/0039995 A1 2/2009 Kipp et al.
2009/0044357 A1 2/2009 Chan et al.
2009/0054925 A1 2/2009 Cho
2009/0071499 A1 3/2009 Wyatt et al.
2009/0071502 A1 3/2009 Drugeon
2009/0089949 A1 4/2009 Mink et al.
2009/0090375 A1 4/2009 Tran
2009/0097899 A1 4/2009 Carroll
2009/0119863 A1 5/2009 Gallegos
2009/0131977 A1 5/2009 Ross
2009/0183328 A1 7/2009 King
2009/0194127 A1 8/2009 Pires et al.
2009/0194129 A1 8/2009 Junemann
2009/0200184 A1 8/2009 Cullen
2009/0211939 A1 8/2009 Cho
2009/0260172 A1 10/2009 Weiss
2009/0272399 A1 11/2009 Kim
2010/0001541 A1 1/2010 Sugiyama
2010/0017990 A1 1/2010 Piao
2010/0037407 A1 2/2010 Telwar
2010/0043815 A1 2/2010 Levy et al.
2010/0059080 A1 3/2010 Gueret
2010/0095973 A1 4/2010 Shrier et al.
2010/0163071 A1 7/2010 Everett, Jr. et al.
2010/0324594 A1 12/2010 Mercanti
2011/0056505 A1 3/2011 Parkinson et al.
2011/0083690 A1 4/2011 Cardenas et al.
2011/0116857 A1 5/2011 Carroll et al.
2011/0174823 A1 7/2011 Silva
2011/0198453 A1 8/2011 Volk
2011/0198454 A1 8/2011 Volk
2011/0266297 A1 11/2011 Thorpe et al.
2011/0315161 A1 12/2011 Lim et al.
2012/0017930 A1 1/2012 Nance
2012/0054971 A1 3/2012 Dugan
2012/0159731 A1 6/2012 Liu et al.
2012/0204899 A1 8/2012 Uehara et al.
2012/0260931 A1 10/2012 Martin et al.
2012/0272982 A1 11/2012 Telwar et al.
2012/0294666 A1 11/2012 Jang
2012/0295216 A1 11/2012 Dykes et al.
2012/0312315 A1 12/2012 Gueret
2013/0017010 A1 1/2013 Liu
2013/0111683 A1 5/2013 Lim et al.
2013/0199556 A1 8/2013 Lim
2014/0014659 A1 1/2014 Thorpe et al.
2014/0023689 A1 1/2014 Kim et al.
2014/0154295 A1 6/2014 Sim et al.
2014/0219701 A1 8/2014 Eberlein

(56) References Cited

U.S. PATENT DOCUMENTS

| | | | |
|---|---|---|---|
| 2014/0259489 | A1 | 9/2014 | Dale |
| 2014/0325775 | A1 | 11/2014 | Nakamura et al. |
| 2014/0331422 | A1 | 11/2014 | Lim |
| 2014/0332027 | A1 | 11/2014 | Lim |

FOREIGN PATENT DOCUMENTS

| | | | |
|---|---|---|---|
| CN | 201308219 | Y | 9/2009 |
| CN | 201399985 | Y | 2/2010 |
| CN | 301313366 | S | 8/2010 |
| CN | 201610006 | U | 10/2010 |
| CN | 101884463 | A | 11/2010 |
| CN | 301542018 | S | 5/2011 |
| CN | 202588745 | U | 12/2012 |
| CN | 302457092 | S | 6/2013 |
| DE | 2111893 | A1 | 9/1972 |
| DE | 3232227 | A1 | 3/1984 |
| DE | 4215896 | C1 | 11/1993 |
| DE | 29713124 | U1 | 9/1997 |
| DE | 29807245 | U1 | 6/1998 |
| DE | 10038850 | A1 | 2/2002 |
| EP | 2084986 | A2 | 8/2009 |
| EP | 2301379 | A1 | 3/2011 |
| FR | 2464674 | A | 3/1981 |
| FR | 2642283 | A1 | 8/1990 |
| FR | 2976463 | A | 12/2012 |
| JP | 2003033228 | A | 2/2003 |
| JP | 2003135140 | A | 5/2003 |
| JP | 2004041260 | A | 2/2004 |
| JP | 1218834 | S | 10/2004 |
| JP | 2007068945 | A | 3/2007 |
| JP | 1343552 | S | 11/2008 |
| JP | 2009172300 | A | 8/2009 |
| KR | 200262437 | A | 3/2002 |
| KR | 300365471 | S | 10/2004 |
| KR | 300404554 | S | 1/2006 |
| KR | 200432010 | Y1 | 11/2006 |
| KR | 300525977 | S | 9/2008 |
| KR | 30-0607863 | S | 8/2011 |
| KR | 30-0672266 | S | 3/2012 |
| KR | 30-0681633 | S | 11/2012 |
| WO | 9211785 | A1 | 7/1992 |
| WO | 2007117091 | A1 | 10/2007 |
| WO | 2009031851 | A2 | 3/2009 |
| WO | 2010098997 | A1 | 9/2010 |

OTHER PUBLICATIONS

Amazon: L'Oreal Brow Stylist Professional 3-in-1 brow tool; retrieved on Jun. 27, 2013 at: http://www.amazon.com/Loreal-Brow-Stylist-Professional-Blonde/dp/B001KYo7AY, 5 pages.

Benjabelle, "Mini Brush Tree" retrieved on Sep. 1, 2014 at <http://www.benjabelle.com/collections/brush-trees/product/mini-brush-tree>>, 3 pages.

"Car Wash Brushes," Martin Cox Chamois Ltd, retrieved on Oct. 16, 2014 at <<http://www.martincoxchamois.com/flow_through_car_wash_brushes.html>>, 8 pages.

"Clarisonic" retrieved on Dec. 19, 2013 at <<http://www.clarisonic.com/>> 5 pages.

CN 3412782 Registered Design, (Tianjin Samsung Brushes Ltd.) Dec. 22, 2004 [online], [retrieved on Oct. 3, 2014] Retrieved from the Questel Intellectual Property Portal Design Database Using the Internet: <URL; http://www.orbit.com>.

CN 3412783 Registered Design, (Tianjin Samsung Brushes Ltd.) Dec. 22, 2004 [online], [retrieved on Oct. 3, 2014] Retrieved from the Questel Intellectual Property Portal Design Database Using the Internet: <URL; http://www.orbit.com>.

CN 3412785 Registered Design, (Tianjin Samsun Brushes Ltd.) Dec. 22, 2004, [online], [retrieved on Oct. 3, 2014] Retrieved from the Questel Intellectual Property Portal Design Database using the Internet: <URL: http://www.orbit.com>.

CN 3417893 Registered Design, (Tianjin Samsun Brushes Ltd.) 2005-01-12, [online], [retrieved on Oct. 3, 2014] Retrieved from the Questel Intellectual Property Portal Design Database using the Internet: <URL: http://www.orbit.com>.

CN 3466155 Registered Design, (Tianjin Samsung Brushes Ltd.) Aug. 10, 2005 [online], [retrieved on Aug. 26, 2014] Retrieved from the Questel Intellectual Property Portal Design Database Using the Internet: <URL; http://www.orbit.com>.

Da Vinci Catalog, Novelties 2005-2008, © Jan. 2008 [online], Top-point Mix B series 5535 Brushes, [retrieved on Mar. 13, 2015]. Retrieved from the Internet: <URL: http://www.davinci-defect.com>.

"Dual Interchangeable Brush Set", Global Market, retrieved on Mar. 18, 2015 at <<http://www.glabalmarket.com/product-info/dual-interchangeable-brush-set-468011.html>>, 2 pages.

Ebay: L'Oreal Brow Stylist Professional 3-in-1 brow tool; retrieved on Jun. 27, 2013 at: http://www.ebay.com/itm/Loreal-Brow_Stylist-3-in-1-Tool-Tweezer-Pencil-Brush-/360388299897; 3 pages.

Everbluec Singapore Beauty Makeup and Skincare Blog, May 14, 2011 [online], Elizabeth Arden makeup blender, [retrieved on Mar. 14, 2015] Retrieved from the Internet: http://everblue.com/2011/05/ceramide-colors-exclusive-launch-at.html>.

"Fingermax Creative Finger Painting Paint Brush", retrieved on Oct. 9, 2014 at ,,http://thesotre.com/fingermax-creative-finger-painting-paint-brush/TSHVY6X6YF>>, 5 Pages.

Foam Finger Wax Applicator, retrieved on Nov. 6, 2014 at <<http://www.cleanyourcar.co.uk/accessories/foam-finger-waxapplicators-pkg/2/prod_633.html>>, 2 pages.

"Givenchy Demesure Audacious Lashes Mascara," May 17, 2011, retrieved from the internet at <<http://www.fashionizers.com/perfumes-makeup/givenchu-demesure-audacious-lashes-mascara/>>, 9 pages.

Givenchy Parfums Maquillage, Soins, Parfums, retrieved on May 14, 2010 at <<http://www.parfumsgivenchy.com/make_up/collections/2010_summer_collection/products_in_this_collection/le_prisme_yeux_island_camaieu_limited_edition/product_5_183_1128_214.html>> 1 page.

Givenchy Summer Makeup Collection 2010 Review and Swatches, retrived on May 14, 2010 at <<http://www.musingsofamuse.com/2010/04/givenchy-summer-makeup-collection-2010-review-and-swatches.html>> 20 pages.

Indeutsch May 2003 [online], Hobby & Craft Brushes, Series HCS: Squirrel Mop, p. 2, [retrieved on Jun. 30, 2014] Retrieved from the Internet using Web Archive: URL:<http://web.archive.org/web/*/http://www.indeutsch.com>.

"iTech Magnetic & Tourmaline Boar and Nylon Bristle Brush 3¼ Inch", Beauty Encounter Inc.[retrieved on Sep. 9, 2010] <http://www.beautyencounter.com/727428765006.html>.

Lady Zona, "Choosing the Right Make Up Brush", Retrieved on Feb. 24, 2015 at <<http://www.ladyzona.com/choosing-the-right-make-up-brush/>>, 3 pages.

"Latest design double end kabuki blush brush", Alibaba.com, retrieved on Mar. 18, 2015 at <<http://www.alibaba.com/product-detail/Latest-design-double-end-kabuki-blush_668701458.html>>, 3 pages.

"Launch Pad Mojo Magpro Professional Magnetic Brush Set", Beauty and the Blog, retrieved on Feb. 26, 2015 at <<http://www.beautyandblog.com/2012/01/launch-pad-mojo-magpro-professional.html>>, 4 pages.

LeKeux, "My Cosmetic Range"LeKeux HQ, retrieved on Feb. 24, 2015 at <<http://lekeuxhq.blogspot.com/2014/11/my-cosmetics-range.html>>, 6 Pages.

Little Blue Chairs, "My first Giveaway at Little Blue Chairs!" Retrieved on Apr. 10, 2013 at <<http://www.littlebluechairs.com/2011/02/my-first-giveaway-at-little-blue-chairs.html>> 8 pages.

"Makeup Brushes Buying Guide", Ebay, Jun. 9, 2014, retrieved on Mar. 18, 2015 at <<http://www.ebay.com/gds/Makeup-Brushes-Buying-Guide-/100000000177404992/g.html>>, 6 pages.

"MelodySusie", retrieved on Oct. 9, 2014 at <<http://amazon.com/MelodySusie-Apllicatior-Milti-Functional-Vibration-Foundation/dp/B00B4QGM1A/ref=aag_m_pw_dpie=UTF8&m=A24IL96TV4XLBY>>, 4 pages.

(56) References Cited

OTHER PUBLICATIONS

Moddea, retrieved on Oct. 16, 2014 at <<http://moddea.com/2012/10/>>, 15 pages.
Nixon, "Optometric Office", retrieved on Oct. 9, 2014 at <<http://www.optometricoffice.com?OO/OO-Archive/BIGGER-IS-BETTER-3436.aspx>>, 2 pages.
"Non Optional UK Beauty and Lifestyle Blog", posted by Nicola Surrey, retrieved on Jan. 9, 2015 at <<http://non-optional.blogspot.com/2012_08_01_archive.html>>, Aug. 2012 {2012}, Sephora classic Mineral Powder Brush, p. 16, 24 pages.
"Popcorn Yubi-fude Finger Brush", Japan Trend Shop, retrieved on Oct. 8, 2014 at <<http://www.japantrendshop.com/popcorn-yubifude-finger-brush-p-939.html>>, 3 pages.
"Series of innovations for makeup brushes", Premium Beauty Media, retrieved on Feb. 26, 2015 at <<http://www.premiumbeautynews.com/en/Series-of-innovations-for-make-up,3232>>, 2 pages.
"Silicone Blackhead Cleanser Nose Pore Brush Cleaner Remover Finger Tool", retrieved on Oct. 9, 2014 at <<Silicone Blackhead cleanser Nose Pore Brush cleaner Remover Finger Tool>>, 2 pages.
"Silicone Nose Pore Clean Finger Brush Blackhead Extractor Remover Facial Scrub Pad Tool", retrieved on Oct. 9, 2014 at <<http://www.alibaba.com/produckt-detail/Silicone-Nose_Pore-Clean-Finger-Brush_900763337.html>>.9 pages.
"Teeth Brushing for cats and dogs", retrieved on Oct. 9, 2014 at <<Teeth Brushing for cats and dogs>>, 7 pages.
The Brush Guard; http://www.thebrushguard.com/ retrieved Oct. 25, 2011, 1 page.
"The Makeup Bullet" retrieved on Oct. 9, 2014 at <<http://themakeupbullet.com/>>, 1 pages.
Wholesale-mn-2 Pcs Portable Cosmetics Telescopic Lip, retrieved on Oct. 16, 2014 at <<http://www.dhgate.com/product/wholesale-mn-2-pcs-portable-cosmetics-telescopic/200881505.html#s1-2-1|2462569649>>, 7 pages.
"Why Didn't We Think of That: Magnetic Makeup Brush", Gloss Daily, retrieved on Feb. 26, 2015 at <<http://www.glossdaily.com/blogs/glossdaily/2012/05/31/magnetic-makeup-brush/>>, 2 pages.
"Brush Cleaning Glove", Sigma Spa, retireved on Oct. 16, 2014 at <<http://www.sigmabeauty.com/Sigma_Spa_Brush_Cleaning_Glove_p/bc001.htm>>, 2 pages.
"Brushegg", retrieved on Oct. 23, 2014 at <<http://brushegg.bigcartel.com/product/brushegg>>, 2 pages.
"Furbuster 3 in 1 Dog Grooming Glove", Petmate 89801, retrieved on Oct. 16, 2014 at <<Furbuster 3 in 1 Dog Grooming>>, 6 pages.

* cited by examiner

COSMETIC BRUSH CLEANING AID

BACKGROUND

Cosmetic brushes generally have a head (e.g., bristles, sponge, etc.) attached to one end of a handle. Handles may be made of various materials such as wood, metal, plastic, etc. Bacteria, oils, make-up, medicines, and debris transmit from skin to cosmetic brush heads and handles every time cosmetic brushes are used to apply makeup, medicine, etc. Accordingly, one of the most important things cosmetic users may do to prolong the life of their cosmetic brushes may be to regularly clean their cosmetic brushes. Regular cleaning may help remove old makeup, dirt and debris, dead skin cells, bacteria, and oils from the fibers that make up the heads of cosmetic brushes and/or the handles. Additionally, regular cleaning may maintain the softness of the fibers that make up heads of cosmetic brushes. That is, regular cleaning may keep cosmetic brushes soft, supple, and free from bacteria, oils, and other debris. Generally, cosmetic brushes should be cleaned as regularly as one time per week.

Current techniques direct a cosmetic user to manually clean the fibers that make up the head of the cosmetic brush by combining a cleaner (e.g., soap, oil, specialized cleaning product, etc.) with water and manually massaging the fibers until the fibers feel clean. Often times, cosmetic users experience difficulty in drawing out all of the make-up, dirt, debris, etc., in the fibers that make up the head of the cosmetic brush. Cleaning cosmetic brushes is time consuming, inefficient, and in many circumstances, expensive and wasteful. Accordingly, there remains a need for streamlined methods and tools for cleaning cosmetic brushes.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1A:
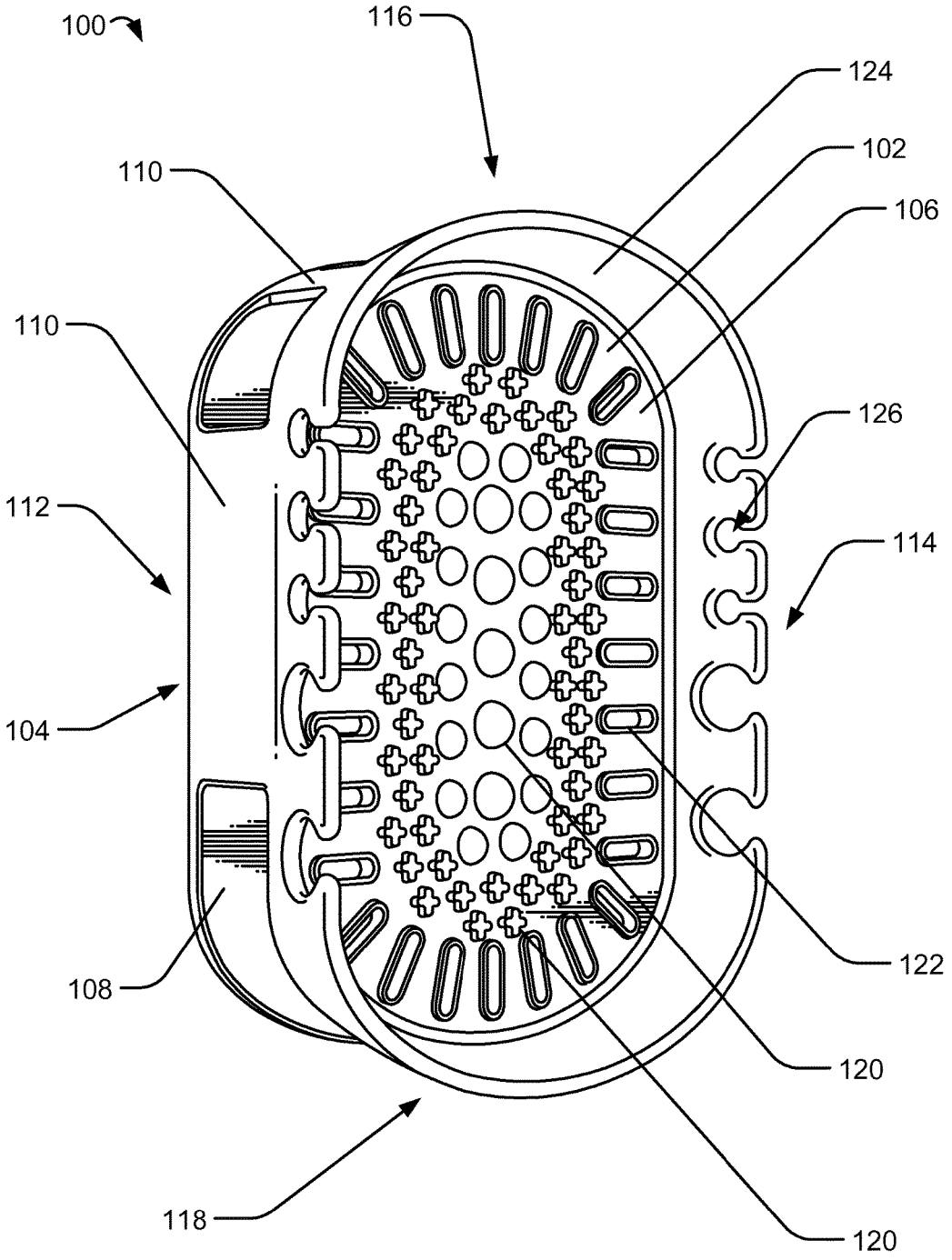
FIG. 1A illustrates an isometric view of an example cosmetic brush cleaning apparatus.

This disclosure is directed to techniques for conveniently storing and/or streamlining cleaning of cosmetic brushes. Cosmetic brushes generally have a fibrous head attached to one end of a handle. Handles may be made of various materials such as wood, metal, plastic, etc. Due to the bacteria, oils, make-up, dead skin cells, and other debris regularly transmitted from skin of a user to cosmetic brush heads and handles, cosmetic brushes should be cleaned regularly. Current techniques direct a user to manually clean the fibers that make up the head of the cosmetic brush by combining a cleaner (e.g., soap, oil, specialized cleaning product, etc.) with water and massaging the head until the fibers feel clean. Often times, cosmetic users experience difficulty in drawing out all of the make-up, dirt, debris, etc., in the fibers that make up the head of the cosmetic brush. Many users purchase expensive cleaning products and repeated washing and rinsing leads to wasting expensive product. Accordingly, current techniques are time consuming, inefficient, and wasteful.

The techniques described herein include cosmetic brush cleaning apparatus and processes for streamlining cleaning, drying, and/or storing cosmetic brushes. The cosmetic brush cleaning apparatus may include a plurality of elevated elements to aid in cleaning fibrous heads of cosmetic brushes by drawing out make-up, dirt, debris, etc., from the fibrous heads of the cosmetic brushes. In some examples, the cosmetic brush cleaning apparatus may include draining mechanisms for removing dirty and/or excess water and helping keep clean water running through the fibrous head of the cosmetic brush. In other examples, the cosmetic brush cleaning apparatus may include an elevated wall that follows a contour of a surface or edge of the cosmetic brush cleaning apparatus. The elevated wall may be elevated to a height greater than the plurality of elevated elements for retaining water within the elevated wall of the cosmetic brush cleaning apparatus. The cosmetic brush cleaning apparatus enables users to deep clean cosmetic brushes more efficiently and using less cleaning product, thereby streamlining the cleaning of cosmetic brushes.

In some examples, the cosmetic brush cleaning apparatus may also be used for efficiently and conveniently drying and/or storing cosmetic brushes. The cosmetic brush cleaning apparatus may include one or more drying mechanisms that may be configured to secure handles of cosmetic brushes and/or allow cosmetic brushes to be arranged in an angled resting position to streamline the drying of cosmetic brushes. The cosmetic brush cleaning apparatus may include hanging devices for attaching the cosmetic brush cleaning apparatus to a surface for drying and/or storing cosmetic brushes (e.g., from a mirror or vanity, etc.) in a vertical position. Attaching the cosmetic brush cleaning apparatus to a surface in a vertical position may prevent the heads from retaining water in the brush ferrule while the cosmetic brushes are drying and/or stored. Alternatively or additionally, the cosmetic brushes may dry and/or be stored in a horizontal position (e.g., in a drawer, on a shelf, etc.). In some examples, storing the cosmetic brush cleaning apparatus in the horizontal position may also prevent the heads from retaining water in the brush ferrule by virtue of drying elements that are configured to elevate the handle of a cosmetic brush above the head of the cosmetic brush.

Illustrative Cosmetic Brush Cleaning Apparatus

FIG. 1 illustrates an isometric view of an example cosmetic brush cleaning apparatus 100. The cosmetic brush cleaning apparatus 100 may be an ovular shape, circular shape, rectangular shape, etc. In some examples, the cosmetic brush cleaning apparatus 100 may have a shape of a mitt or another object (e.g., a head of an animal, a flower, etc.). The cosmetic brush cleaning apparatus 100 may be secured by user interaction with the cosmetic brush cleaning apparatus 100. In some examples, the user may secure the cosmetic brush cleaning apparatus 100 by placing his or her hand in an opening of the cosmetic brush cleaning apparatus and the cosmetic brush cleaning apparatus 100 may be worn like a mitt or glove. In other examples, the user may insert one or more fingers into finger holes, straps, or other gripping or holding mechanisms for securing the cosmetic brush cleaning apparatus 100. In some examples, a user may secure the cosmetic brush cleaning apparatus 100 by holding the cosmetic brush cleaning apparatus 100 in the palm of his or her hand. Additionally or alternatively, the cosmetic brush cleaning apparatus 100 may be secured to a surface during use. For example, the cosmetic brush cleaning apparatus 100 may be secured to a surface by suction cups, feet, straps, other attaching mechanisms, etc. that may be coupled to the cosmetic brush cleaning apparatus 100.

The cosmetic brush cleaning apparatus 100 may be made of any material having properties for repelling water, shedding water, and/or having characteristics making the material impervious to water and/or non-absorbent. For example, the cosmetic brush cleaning apparatus 100 may be made of waterproof, water resistant, and/or water repellant materials. In some examples, the cosmetic brush cleaning apparatus 100 may be made of a flexible material or any material that enables the cosmetic brush cleaning apparatus 100 to be subjected to stress and manipulation and, upon removal of the stress and manipulation, may return to a shape substantially similar to its original shape. Additionally or alternatively, at least some portions of the cosmetic brush cleaning apparatus 100 may be made of a rigid material for maintaining the shape and structure of the cosmetic brush cleaning apparatus 100. For example, the cosmetic brush cleaning apparatus 100 may be made from neoprene, polychloroprene, silicone, thermoplastic elastomers (TPE), thermoplastic polyurethanes (TPU), other materials that may repel water and maintain flexibility and/or rigidity, or some combination of the above.

In at least some examples, at least some portions of the cosmetic brush cleaning apparatus 100 may include an absorbent material (e.g., sponge, chamois, etc.). The absorbent material may be configured to hold cleaning product that may be provided during the cleaning process and/or may be used to provide a scrubbing and/or wiping surface. The absorbent material may be coupled to other materials that may make up the cosmetic brush cleaning apparatus 100 in a variety of ways. For example, the absorbent material may be attached to other materials using an adhesive (e.g., glue, cement, mucilage, paste, etc.). In some examples, the absorbent material may be coupled to the other materials by stitching, welding, lacing, screwing, bolting, stapling, riveting, melting, chemical bonding, or some combination of the above. In other examples, the absorbent material may be removably coupled to the other materials by buttons, snaps, hooks and loops (e.g., Velcro®), etc.

The cosmetic brush cleaning apparatus 100 may include a front surface 102 and a back surface 104, the back surface 104 being opposite the front surface 102. In some examples, the front surface 102 and the back surface 104 may be associated with separate sheets of material. For example, a front surface of a top sheet 106 may be the front surface 102 and a back surface of a bottom sheet 108 may be the back surface 104. The top sheet 106 and the bottom sheet 108 may be separated by one or more separators 110 that are interposed between the top sheet 106 and the bottom sheet 108. In such examples, a user may insert his or her hand into the space between the top sheet 106 and the bottom sheet 108 and the one or more separators 110 may secure the cosmetic brush cleaning apparatus 100 over the hand of the user. In other examples, the front surface 102 and the back surface 104 may be associated with a single sheet, block, or other body of material.

In some examples, the one or more separators 110 may be formed by cutouts around the perimeter of the cosmetic brush cleaning apparatus 100. In at least one example, the one or more separators 110 may be a single separator that follows the contour of the cosmetic brush cleaning apparatus 100 and couples the top sheet 106 and the bottom sheet 108 along a portion of the perimeter of the cosmetic brush cleaning apparatus 100. That is, the separator may be a single piece having a single cutout for receiving a user's hand. In alternative examples, the one or more separators 110 may be formed from various cutouts around the perimeter of the cosmetic brush cleaning apparatus 100, as shown in FIG. 1A. For example, as a result of a plurality of cutouts, a first separator of the one or more separators 110 may be associated with a first edge 112 of the cosmetic brush cleaning apparatus 100 and a second separator of the one or more separators 110 may be associated with a second edge 114 of the cosmetic brush cleaning apparatus 100, the second edge 114 being opposite the first edge 112. Additionally, a third separator of the one or more separators 110 may be associated with a top edge 116 of the cosmetic brush cleaning apparatus 100 opposite a bottom edge 118. That is, cutouts between the first separator, second separator, and third separator define the individual separators 110. The bottom edge 118 may have a cutout for receiving a user's hand and the separators 110 attached to the first edge 112, second edge 114, and top edge 116 may secure the user's hand in the cosmetic brush cleaning apparatus 100. While the one or more separators 110 are described as cutouts, in other examples, the cosmetic brush cleaning apparatus 100 may be molded from a single piece of material to include the one or more separators 110.

In other examples, the one or more separators 110 may be attached to the top sheet 106 and the bottom sheet 108. The one or more separators 110 may be made of the same or different material than the top sheet 106 and/or the bottom sheet 108. The one or more separators 110 may be attached to the top sheet 106 and the bottom sheet 108 by a variety of processes. For example, the one or more separators 110 may be attached to the top sheet 106 and the bottom sheet 108 using an adhesive (e.g., glue, cement, mucilage, paste, etc.). In other examples, the one or more separators 110 may be attached to the top sheet 106 and the bottom sheet 108 by stitching, welding, lacing, screwing, bolting, stapling, riveting, melting, chemical bonding, or some combination of the above. In some examples, a single separator may be attached to the top sheet 106 and bottom sheet 108 around a portion of the perimeter. In other examples, two or more separators 110 may be attached to the top sheet 106 and the bottom sheet 108. For instance, a first separator of the two or more separators 110 may be attached to a first edge 112 associated with the top sheet 106 and the bottom sheet 108 and a second separator of the two or more separators 110 may be attached to a second edge 114 associated with the top sheet 106 and the bottom sheet 108, the second edge 114 opposite the first edge 112. Additionally, a third separator may be attached to a top edge 116 associated with the top sheet 106 and the bottom sheet 108, the top edge 116 opposite a bottom edge 118. The bottom edge 118 may have an opening for receiving a user's hand and the separators 110 associated with the first edge 112, second edge 114, and top edge 116 may secure the user's hand in the cosmetic brush cleaning apparatus 100.

The front surface 102 of the cosmetic brush cleaning apparatus 100 may include a plurality of elevated cleaning elements 120. The elevated cleaning elements 120 may be elevated to a predetermined height above the front surface 102 of the cosmetic brush cleaning apparatus 100. The elevated cleaning elements 120 may take the form of a variety of shapes. In some examples, the elevated cleaning elements 120 may be crosses, rectangles, concave circles, convex circles, etc. In other examples, the elevated cleaning elements 120 may be shapes of abstract objects and/or objects such as hearts, stars, animals, trademarks, etc. The elevated cleaning elements 120 may have various sizes. The elevated cleaning elements 120 may be arranged in groups of same shapes and groups of the same shapes may be arranged in various configurations. The different shapes and/or sizes of the elevated cleaning events may create elevated cleaning elements 120 having different utilities. For instance, circular elevated cleaning elements 120 may be used for large cosmetic brush heads and cross-shaped elevated cleaning elements 120 may be used for small cosmetic brush heads. Additionally or alternatively, rectangular elevated cleaning elements 120 may be used for rinsing cosmetic brush heads of any size.

In some examples, the elevated cleaning elements 120 may be stamped in the piece of material associated with the front surface 102 and/or the top sheet 106 may be formed by a mold that includes the elevated cleaning elements 120 on the front surface 102 such that the elevated cleaning elements 120 are integrated in the piece of material associated with the front surface 102. In other examples, the elevated cleaning elements 120 may be coupled to the front surface 102. The elevated cleaning elements 120 may be of the same and/or different materials as the top sheet 106. For example, the elevated cleaning elements 120 may be attached to the front surface 102 using an adhesive (e.g., glue, cement, mucilage, paste, etc.). In other examples, the elevated cleaning elements 120 may be attached to the front surface 102 by stitching, welding, lacing, screwing, bolting, stapling, riveting, melting, chemical bonding, or some combination of the above.

Additionally or alternatively, the cosmetic brush cleaning apparatus 100 may include recessed cleaning elements. The recessed cleaning elements may be recessed into the piece of material associated with the front surface 102. The recessed cleaning elements may be formed by cutouts, stamps, and/or a mold, as described above.

In some examples, the cosmetic brush cleaning apparatus 100 may include draining mechanisms 122 for draining water from cosmetic brushes and/or the cosmetic brush cleaning apparatus 100. In some examples, the front surface 102 of the cosmetic brush cleaning apparatus 100 may include one or more draining mechanisms 122 that are cutout from the front surface 102 and are configured to allow water to drain from the front surface 102 of the cosmetic brush cleaning apparatus 100, as shown in FIG. 1A. While the one or more draining mechanisms 122 are described as cutouts, in other examples, the cosmetic brush cleaning apparatus 100 may be molded from a single piece of material to include the one or more draining mechanisms. The draining mechanisms 122 may be any shape and/or size. For instance, the draining mechanisms 122 may be rectangular, circular, ovular, star-shaped, flower-shaped, etc. In some examples, the draining mechanisms 122 may be arranged around a perimeter of the front surface 102 in an arrangement that follows a contour of the shape of the front surface 102, as shown in FIG. 1A. In other examples, the draining mechanisms 122 may be arranged in various other configurations. The draining mechanisms 122 disposed on the front surface 102 may be used to drain dirty water from the front surface 102 during the cleaning process and may also be used to drain excess water from cosmetic brush heads during the drying process. In some examples, the draining mechanisms 122 may also be used for securing the cosmetic brush cleaning apparatus 100.

The front surface 102 of the cosmetic brush cleaning apparatus 100 may include an elevated wall 124. The elevated wall 124 may be an extension of the front surface 102 that follows the contour of the cosmetic brush cleaning apparatus 100 along the perimeter of the front surface 102. The elevated wall 124 may be elevated to a height above the elevated cleaning elements 120 relative to the front surface 102 so that the elevated wall 124 may retain water on the front surface 102 and/or be used for drying and/or storage. The elevated wall 124 may follow the contour of the cosmetic brush cleaning apparatus 100 at a same height or at different heights. In examples where the front surface 102 does not include draining mechanisms 122, the elevated wall 124 may be used to collect water for minimizing the amount of product user's use for cleaning their cosmetic brushes. In additional or alternative examples, the elevated wall 124 may include drying elements 126, as described below.

In some examples, the elevated wall 124 may be a contiguous part of the piece of material associated with the front surface 102 such that the elevated wall 124 protrudes from the front surface 102. In other examples, the elevated wall 124 may be coupled to the sheet associated with the front surface 102. For instance, the elevated wall 124 may be attached to the sheet associated with the front surface 102 using an adhesive (e.g., glue, cement, mucilage, paste, etc.). In other examples, the elevated wall 124 may be attached to the front surface 102 by stitching, welding, lacing, screwing, bolting, stapling, riveting, melting, chemical bonding, or some combination of the above.

The cosmetic brush cleaning apparatus 100 may include one or more drying elements 126. In some examples, the one or more drying elements 126 may be associated with the back surface 104 and/or the elevated wall 124. In some examples, the one or more drying elements 126 may be cutouts in the elevated wall 124. The cutouts or openings may be cut out of or formed in a portion of the first edge 112 of the cosmetic brush cleaning apparatus 100 and corresponding portion of the second edge 114 of the cosmetic brush cleaning apparatus 100. That is, each cutout on the first edge 112 may have a corresponding cutout directly across from it on the second edge 114. This configuration of cutouts may be used for receiving one or more cosmetic brushes and securing the one or more cosmetic brushes above the front surface 102 for drying and/or storage, as shown in FIG. 1B. FIG. 1B illustrates an isometric view of the example cosmetic brush cleaning apparatus 100 of FIG. 1A where drying elements 126 are securing cosmetic brushes 128.

The cutouts may be circular or non-circular (e.g., oval-shaped, slit, wedge-shaped, C-shaped, etc.). In some examples, the cutouts may be cut to standard cosmetic brush handle dimensions to secure cosmetic brushes by placing the cosmetic brushes 128 into the cutouts. In such examples, the cosmetic brushes may fit snugly into the cutouts. In other examples, the cutouts may not be sized as specifically and may be filled with a material for securing the cosmetic brushes 128. The material that may be used to fill the cutouts may be any flexible material that returns to its shape after experiencing stress or manipulation. For example, the flexible material that may be used to fill the cutouts may include, but is not limited to, neoprene, polychloroprene, silicone, thermoplastic elastomers (TPE), thermoplastic polyurethanes (TPU), other flexible materials, or some combination of the above. In at least one example, the material that fills the cutouts may include a foam material configured to hold one or more cosmetic brushes 128. The flexible material may have one or more cutouts for securing handles of cosmetic brushes 128. In at least one example, the cutouts may be arranged in a star configuration for accommodating handles having various diameters. In other examples, the flexible material may include a single cutout, or other configurations for holding handles of cosmetic brushes 128. In some examples, the cutouts in the elevated wall 124 may secure a single handle of a cosmetic brush. In other examples, the cutouts in the elevated wall 124 may secure two or more handles of cosmetic brushes 128.

Figure 1C:
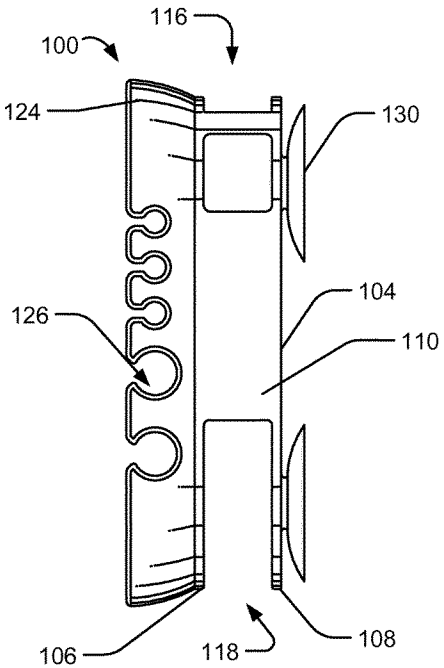
FIG. 1C illustrates a side view of the example cosmetic brush cleaning apparatus of FIG. 1A.
Figure 1B:
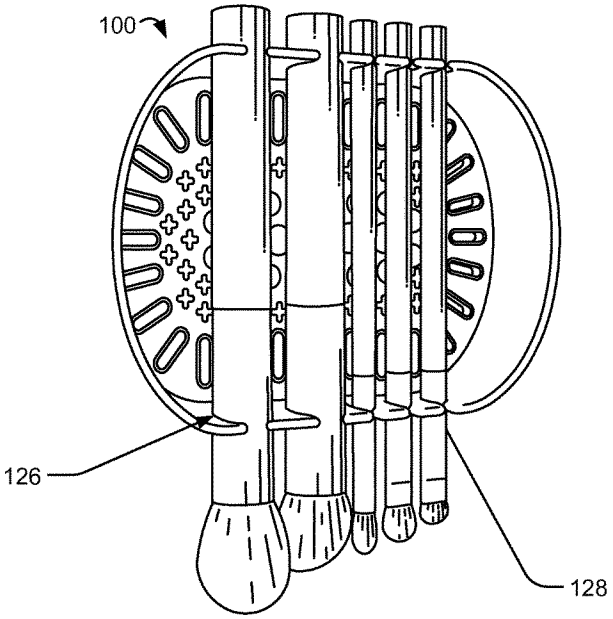
FIG. 1B illustrates an isometric view of the example cosmetic brush cleaning apparatus of FIG. 1A where drying elements are securing cosmetic brushes.

FIG. 1C illustrates a side view of the cosmetic brush cleaning apparatus 100. FIG. 1C may represent a front view of first side 112 and/or second side 114. In some examples, the back surface 104 may be coupled to one or more hanging mechanisms 130 for hanging the cosmetic brush cleaning apparatus 100. For example, hanging mechanisms 130 may include hooks, loops, suction cups, eyelets, grommets, magnets, or other mechanisms that may provide for hanging the cosmetic brush cleaning apparatus 100. The one or more hanging mechanisms 130 may be attached permanently or removably to the back surface 104 using, for example, an adhesive (e.g., glue, cement, mucilage, paste, etc.), stitching, welding, lacing, screwing, bolting, stapling, riveting, melting, chemical bonding, or some combination of the above. Alternatively, the hanging mechanisms 130 may protrude through the back surface 104 such that they are part of the back surface 104. In other examples, the hanging mechanisms 130 may be coupled to the front surface 102 of the cosmetic brush cleaning apparatus 100. For example, the hanging mechanisms 130 may be hooks or loops that extend beyond the top edge 116 or bottom edge 118 of the cosmetic brush cleaning apparatus 100.

The hanging mechanisms 130 may be used for hanging the cosmetic brush cleaning apparatus 100 such that the cosmetic brushes 128 are hanging upside down, as shown in FIG. 1B. Returning to FIG. 1B, FIG. 1B illustrates an isometric view of a cosmetic brush cleaning apparatus 100 hanging upside down from one or more hanging mechanisms (not shown). As shown in FIG. 1B, the cosmetic brush cleaning apparatus 100 may hang from the hanging mechanisms 130 so that the heads of the cosmetic brushes 128 hang toward the ground and any water retained in the fibers of the heads may drip away from the heads of the cosmetic brushes 128.

The cosmetic brush cleaning apparatus 100 may be stored in a similar configuration, such as hanging from the hanging mechanisms 130 on a wall, vanity, door, etc. In some examples, the cosmetic brush cleaning apparatus 100 may be stored flat in a drawer, on a shelf, etc. In other examples, the cosmetic brush cleaning apparatus 100 may be configured to be stored in stands specifically designed for storing the cosmetic brush cleaning apparatus 100.

Figure 2A:
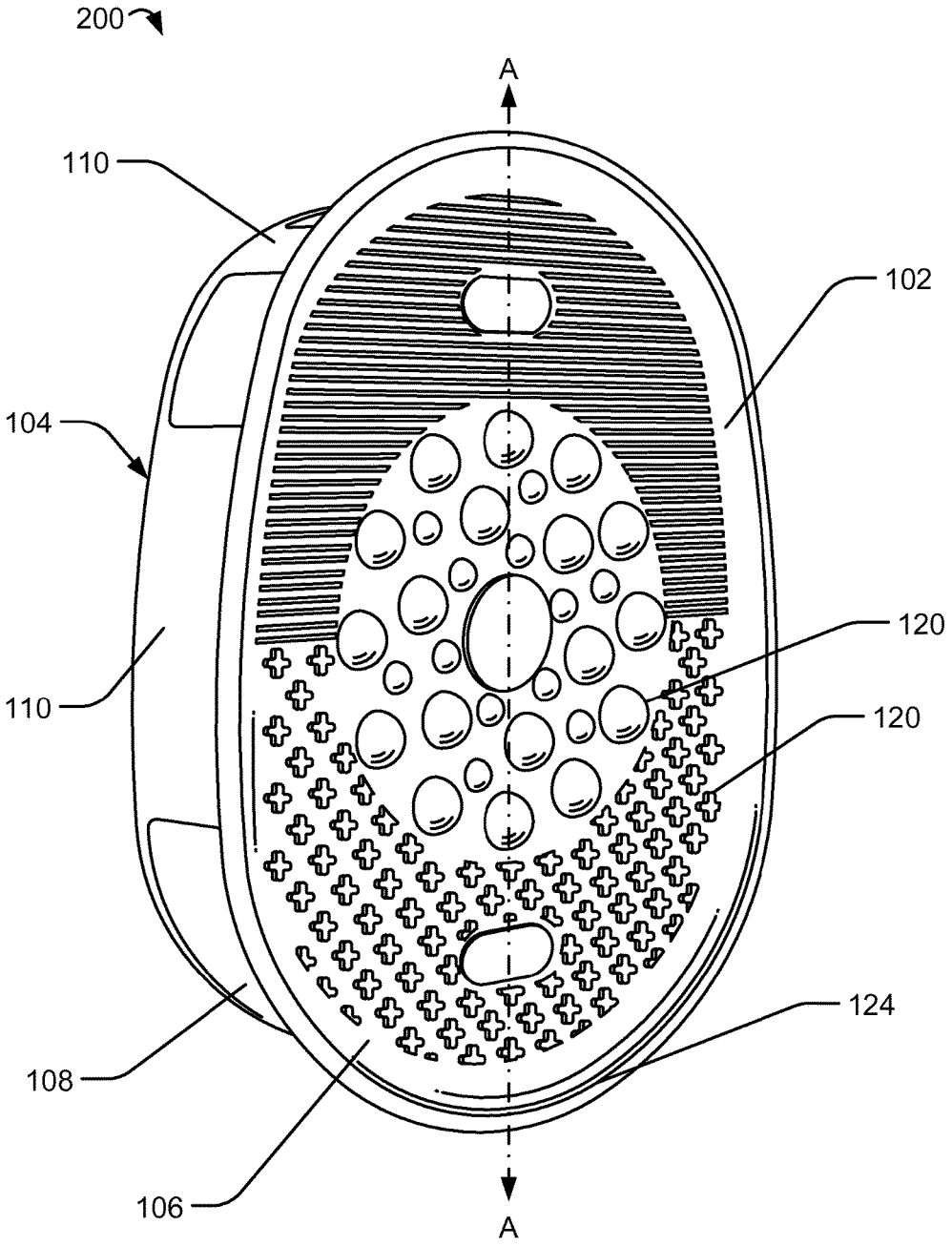
FIG. 2A illustrates an isometric view of another example cosmetic brush cleaning apparatus.

FIG. 2A illustrates an isometric view of another example cosmetic brush cleaning apparatus 200. FIG. 2A illustrates a cosmetic brush cleaning apparatus 200 having an ovular shape. As described above, however, the cosmetic brush cleaning apparatus 200 may have a variety of shapes. As illustrated in FIG. 2A, the front surface 102 is associated with a front surface of a top sheet 106 and the back surface 104 is associated with a back surface of a bottom sheet 108. The top sheet 106 and bottom sheet 108 are separated by one or more separators 110, as shown and discussed above in the context of FIG. 1A. The front surface 102 includes a plurality of elevated cleaning elements 120 for working out debris, make-up, dead skin cells, etc. from the fibrous heads of cosmetic brushes, as described above. The cosmetic brush cleaning apparatus 200 of FIG. 2A does not include draining mechanisms 122 for draining water or drying elements 126 that are cut from or formed in the elevated wall 124. However, the cosmetic brush cleaning apparatus 200 may include draining mechanisms 122 disposed on the front surface 102 and/or back surface 104 and/or drying elements 126 that may be associated with the elevated wall 124. The cosmetic brush cleaning apparatus 200 of FIG. 2A also includes an elevated wall 124, as described above, for retaining water on the top sheet 106 and minimizing the amount of water and/or product used to clean cosmetic brushes. In at least some examples, the elevated wall 124 may include one or more drying elements 126, as described above.

Figure 2C:
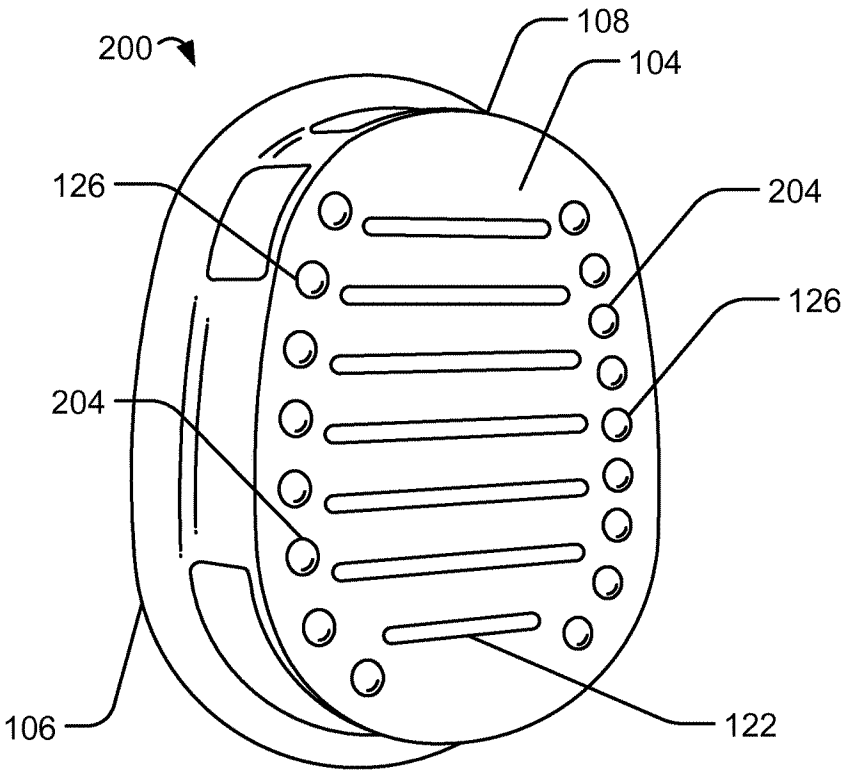
FIG. 2C illustrates yet another isometric view of the example cosmetic brush cleaning apparatus of FIG. 2A.
Figure 2B:
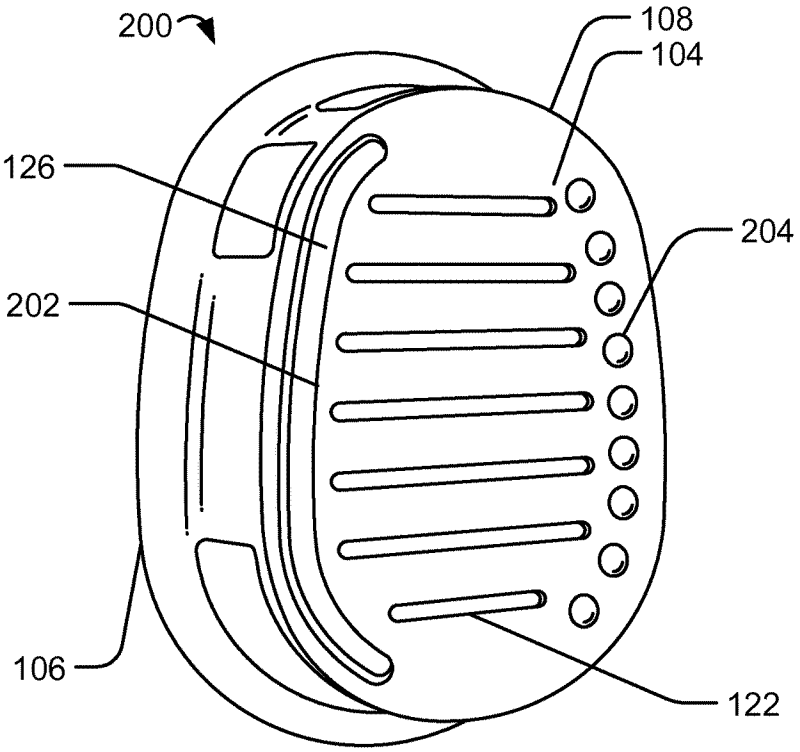
FIG. 2B illustrates another isometric view of the example cosmetic brush cleaning apparatus of FIG. 2A.

FIG. 2B illustrates another isometric view of the example cosmetic brush cleaning apparatus 200 of FIG. 2A. As shown in FIG. 2B, the back surface 104 of the cosmetic brush cleaning apparatus 200 may include one or more draining mechanisms 122 configured to allow water to drain from the back surface 104 of the cosmetic brush cleaning apparatus 200. The draining mechanisms 122 may include cutouts that may be associated with the back surface 104 and, in some examples, may penetrate through the bottom sheet 108. While the draining mechanisms 122 are described as cutouts, in other examples, the cosmetic brush cleaning apparatus 100 may be molded from a single piece of material to include the draining mechanisms 122. In at least some examples, the cosmetic brush cleaning apparatus 200 may be configured so that the cosmetic brush cleaning apparatus 200 is resting on the top sheet 106 and the back surface 104 may be used for drying cosmetic brushes 128. Using the drying elements 126 described below, the one or more cosmetic brushes 128 may be set on the back surface 104 at an angle relative to the back surface 104 so that excess water may drain from the heads of the one or more cosmetic brushes 128 onto the back surface 104, and the excess water may drain from the back surface 104 through the one or more cutouts. Like the draining mechanisms 122 in the front surface 102, the draining mechanisms 122 in the back surface 104 may be any shape and/or size. The draining mechanisms 122 shown in FIG. 2B are linear cutouts. However, the draining mechanisms 122 may be circular, ovular, star-shaped, flower-shaped, shaped as a trademark, etc., as described above.

As described above, one or more drying elements 126 may be disposed in the back surface 104 of the cosmetic brush cleaning apparatus 200. The one or more drying elements 126 may include an elevated wedge 202, a plurality of elevated drying elements 204, etc. The elevated wedge 202 and/or the plurality of elevated drying elements 204 may be elevated such that the elevated wedge 202 and/or the plurality of elevated drying elements 204 have a predetermined height above the back surface 104. The plurality of elevated drying elements 204 may have various shapes and/or sizes. In some examples the plurality of elevated drying elements 204 may be circular, rectangular, ovular, etc. In some examples, the elevated wedge 202 and/or plurality of elevated drying elements 204 may be stamped in the piece of material associated with the back surface 104 and/or the bottom sheet 108 may be formed by a mold that includes the elevated wedge 202 and/or plurality of elevated drying elements 204 on the back surface 104 such that the elevated wedge 202 and/or plurality of elevated drying elements 204 are integrated in the piece of material associated with the back surface 104. In other examples, the elevated wedge 202 and/or plurality of elevated drying elements 204 may be attached to the back surface 104 using an adhesive (e.g., glue, cement, mucilage, paste, etc.) or by stitching, welding, lacing, screwing, bolting, stapling, riveting, melting, chemical bonding, or some combination of the above.

FIG. 2B illustrates another isometric view of the example cosmetic brush cleaning apparatus 200 wherein the one or more drying elements 126 include an elevated wedge and a plurality of elevated drying elements 204. In at least one example, the elevated wedge 202 may follow the contour of the cosmetic brush cleaning apparatus 200 and may be coupled to an edge (e.g., first edge 112 or second edge 114) of the cosmetic brush cleaning apparatus 200. An opposite edge (e.g., first edge 112 or second edge 114, respectively) of the cosmetic brush cleaning apparatus 200 may include one or more elevated drying elements 204 or may include the back surface 104 of the bottom sheet 108 without any elevated features. The elevated wedge 202 may be elevated to a height above the elevated drying elements 204 relative to the back surface 104. A user may place a handle of a cosmetic brush 128 on the elevated wedge 202 to elevate the handle of the cosmetic brush 128 above the head of the cosmetic brush 128 that may be resting on the opposite side of the cosmetic brush cleaning apparatus 200. The angled position may allow excess water to drip from the head of the cosmetic brush 128. The one or more draining mechanisms 122 disposed in the back surface 104 may be used for draining the excess water from the cosmetic brush 128 and/or back surface 104.

FIG. 2C illustrates yet another isometric view of the example cosmetic brush cleaning apparatus 200 of FIG. 2A. FIG. 2C illustrates the one or more drying elements 126 as a plurality of elevated drying elements 204 disposed on at least one side of the cosmetic brush cleaning apparatus 200. The plurality of elevated drying elements 204 may follow the contour of the cosmetic brush cleaning apparatus 200 on one edge of the cosmetic brush cleaning apparatus 200 (e.g., first edge 112 and/or second edge 114) and/or another edge of the cosmetic brush cleaning apparatus 200 (e.g., second edge 114 or first edge 112, respectively). The plurality of elevated drying elements 204 may be arranged in a variety of configurations also. A user may place a handle of a cosmetic brush 128 on one of the elevated drying elements 204 to elevate the handle above the head of the cosmetic brush 128 that may be resting on an opposite edge of the cosmetic brush cleaning apparatus 200. The angled position relative to the back surface 104 may allow excess water to drip from the head of the cosmetic brush 128 onto the back surface 104. The one or more draining mechanisms 122 disposed in the back surface 104 may be used for draining the excess water from the cosmetic brush and/or back surface 104.

Figure 2D:
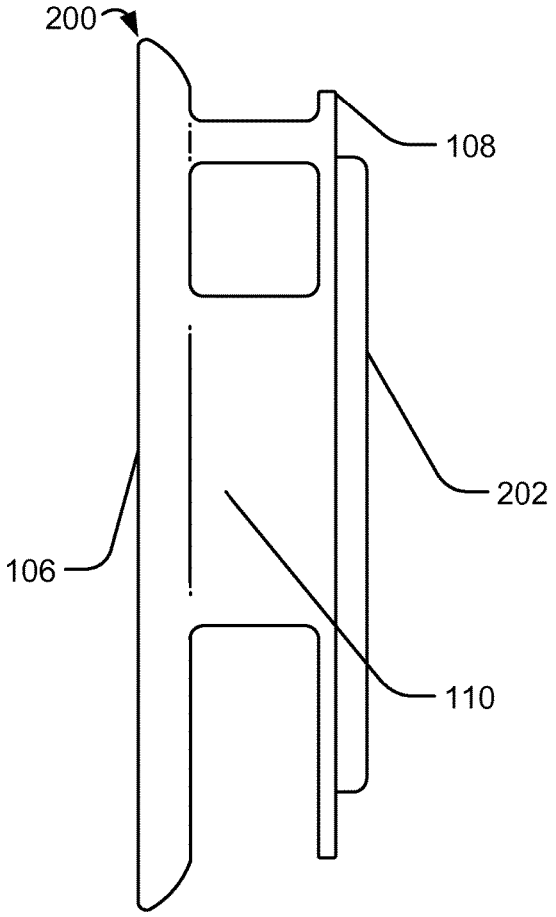
FIG. 2D is a side view of the example cosmetic brush cleaning apparatus of FIG. 2A.
Figure 2E:
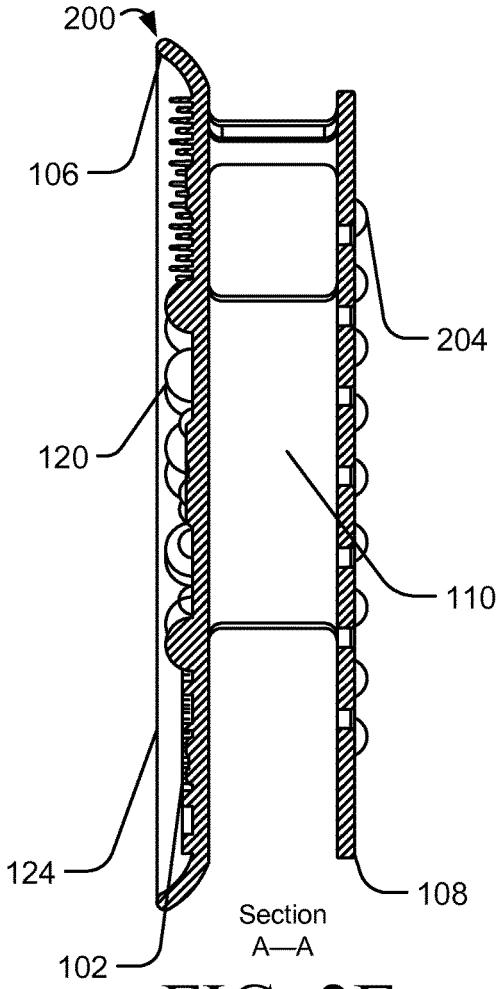
FIG. 2E is a cross-sectional view along traversal line A-A of the example cosmetic brush cleaning apparatus of FIG. 2A.

FIG. 2D is a side view of the example cosmetic brush cleaning apparatus 200 of FIG. 2A. FIG. 2D illustrates a cosmetic brush cleaning apparatus 200 including an elevated wedge 202 on an edge of the cosmetic brush cleaning apparatus 200. FIG. 2E is a cross-sectional view along traversal line A-A of the example cosmetic brush cleaning apparatus of FIG. 2A. FIG. 2E illustrates a cosmetic brush cleaning apparatus 200 including a plurality of elevated drying elements 204 disposed on an edge of the cosmetic brush cleaning apparatus 200. FIG. 2E further illustrates the plurality of elevated cleaning elements 120 disposed on the front surface 102 of the cosmetic brush cleaning apparatus 200. As described above, the one or more drying elements 126 disposed on the back surface 104 may include various combinations of an elevated wedge 202 on an edge and a plurality of elevated drying elements 204 on an opposite edge, a plurality of elevated drying elements 204 on both sides, or a plurality of elevated drying elements 204 or an elevated wedge on an edge and no drying elements on the opposite edge.

Figure 2F:
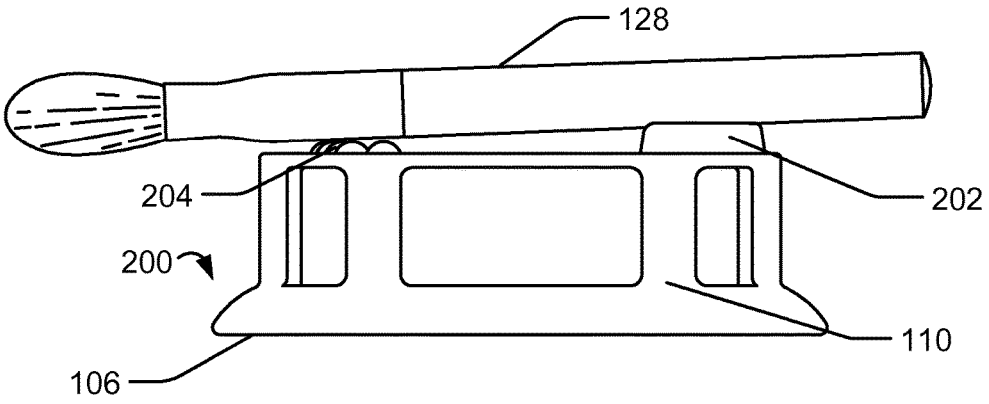
FIG. 2F is a side view of the example cosmetic brush cleaning apparatus configured for drying a cosmetic brush.

FIG. 2F is a side view of the example cosmetic brush cleaning apparatus 200 configured for drying a cosmetic brush 128. FIG. 2F illustrates the handle of a cosmetic brush 128 resting against an elevated wedge 202 on an edge (e.g., first edge 112 or second edge 114) and the head of the cosmetic brush 128 resting on an individual elevated drying element 204 of the plurality of elevated drying elements 204 on an opposite edge (e.g., second edge 114 or first edge 112, respectively). The individual elevated drying element 204 may be elevated less than the elevated wedge 202 so that the cosmetic brush 128 lies at an angle relative to the back surface 104 of the cosmetic brush cleaning apparatus 200. As a result excess water may drain out of the ferrule or head of the cosmetic brush 128. The cosmetic brush 128 may be positioned differently so that the excess water may drain out of the ferrule and the cosmetic brush 128 head and onto the back surface 104 of the cosmetic brush cleaning apparatus 200. The draining mechanisms 122 disposed in the back surface 104 of the cosmetic brush cleaning apparatus 200 may be used for draining excess water from the back surface 104.

Figure 3B:
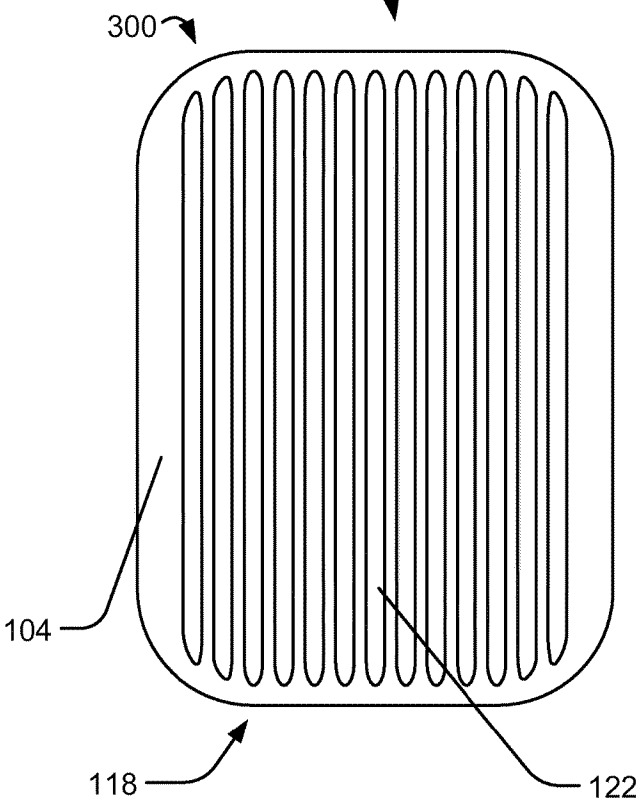
FIG. 3B illustrates a top view of an example back surface of the example cosmetic brush cleaning apparatus of FIG. 3A.
Figure 3A:
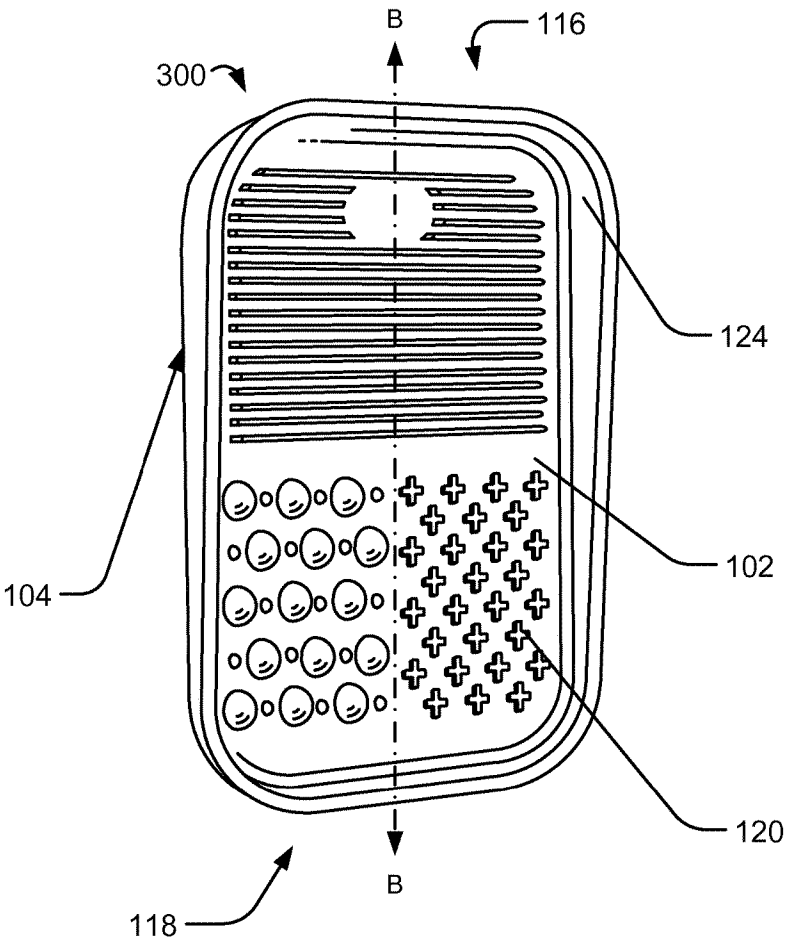
FIG. 3A illustrates an isometric view of yet another example cosmetic brush cleaning apparatus.

FIG. 3A illustrates an isometric view of yet another example cosmetic brush cleaning apparatus 300. The cosmetic brush cleaning apparatus 300 represents an example of a rectangular cosmetic brush cleaning apparatus. As illustrated in FIG. 3A, the front surface 102 and the back surface 104 may be associated with a single sheet, block, or other body of material. The front surface 102 includes a plurality of elevated cleaning elements 120, as described above. The rectangular cosmetic brush cleaning apparatus 300 may include an elevated wall 124 for retaining water during the cleaning process. The elevated wall 124 may follow the rectangle contour of the cosmetic brush cleaning apparatus 300. In some examples of rectangular shaped cosmetic brush cleaning apparatuses 300, the elevated wall 124 may follow the rectangle contour at a same height around the entire perimeter. In other examples, the elevated wall 124 may be at a tallest height towards the top edge 116 of the cosmetic brush cleaning apparatus 300 and may gradually decrease in height along the side edges (e.g., side edge 112 and 114) to a shortest height at the bottom edge 118. As a result of the gradual decline, the cosmetic brush cleaning apparatus 300 may lie on the front surface 102 such that the back surface 104 is configured at an angle relative to a flat support surface for receiving cosmetic brushes for drying and/or storing the cosmetic brushes. That is, setting the cosmetic brushes with the handle resting on the back edge (e.g., top edge 116) of the cleaning apparatus 300 and the brush head resting on or hanging over the front edge (e.g., bottom edge 118) of the cleaning apparatus 300 results in the handles of the brushes being elevated and the brush heads being declined so that water can drain out of the brush heads.

FIG. 3B illustrates a top view of an example back surface of the example cosmetic brush cleaning apparatus of FIG. 3A. The back surface 104 may include a plurality of draining mechanisms 122 for draining excess water, as shown in FIG. 3B. In some examples, the draining mechanisms 122 may not penetrate through the sheet. In other examples, the draining mechanisms 122 may penetrate through the sheet. As described above, cosmetic brush cleaning apparatus 300 may be configured to receive cosmetic brushes for drying and/or storing the cosmetic brushes at an angle relative to a flat support surface. In some examples, the front surface 102 and/or back surface 104 of the cosmetic brush cleaning apparatus 300 may include depressions and/or notches that may be cut in one or more edges of the cosmetic brush cleaning apparatus to act as cradles for cosmetic brushes.

Figure 3D:
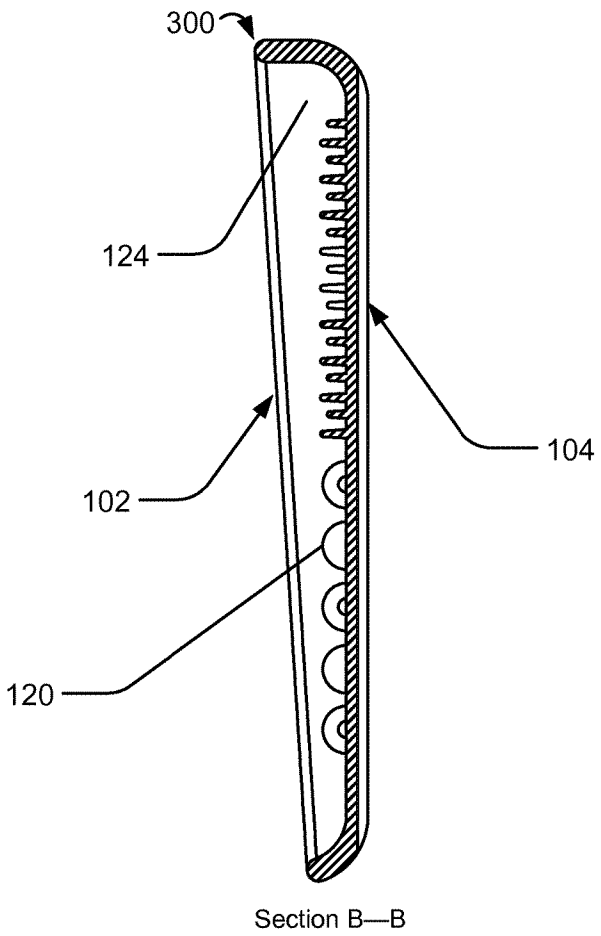
FIG. 3D illustrates a cross-sectional view along traversal line B-B of the example cosmetic brush cleaning apparatus of FIG. 3A.
Figure 3C:
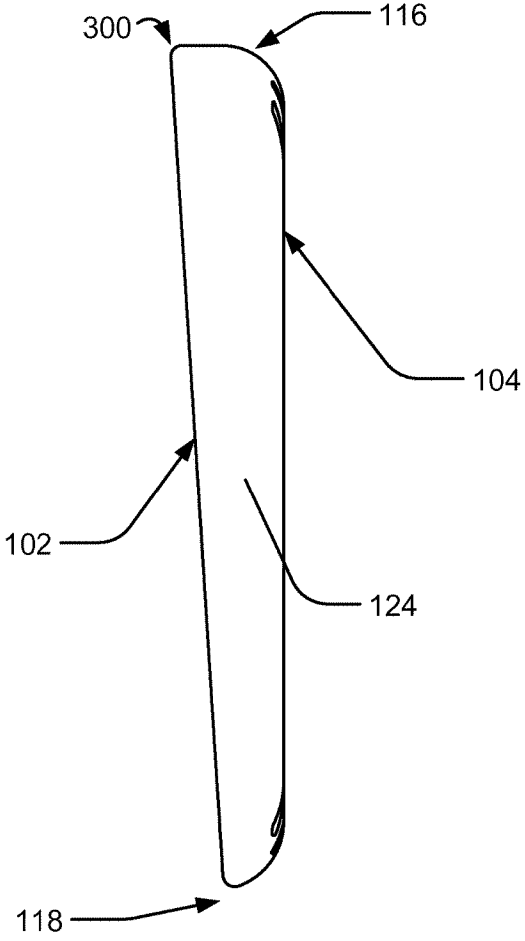
FIG. 3C illustrates a side view of the example cosmetic brush cleaning apparatus of FIG. 3A.

FIG. 3C illustrates a side view of the example cosmetic brush cleaning apparatus 300 of FIG. 3A. FIG. 3C illustrates the gradual decrease of the height of the elevated wall 124 along a side edge (e.g., side edge 112 or 114) of the cosmetic brush cleaning apparatus 300 from the top edge 116 to the bottom edge 118. FIG. 3D illustrates a cross-sectional view along traversal line B-B of the example cosmetic brush cleaning apparatus 300 of FIG. 3A. FIG. 3D illustrates elevated wall 124 being elevated to a height greater than the elevated cleaning mechanisms 120 associated with the front surface 102.

Figure 3E:
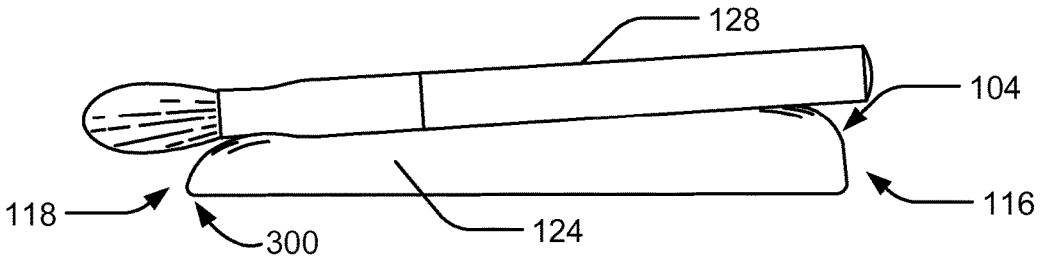
FIG. 3E illustrates a side view of the example cosmetic brush cleaning apparatus of FIG. 3A configured for drying a cosmetic brush.

FIG. 3E illustrates a side view of the example cosmetic brush cleaning apparatus 300 of FIG. 3A configured for drying a cosmetic brush 128. In this example, the apparatus 300 may be inverted and placed top down (e.g., front surface 102 down) on a flat support surface. In FIG. 3E, the handle of a cosmetic brush 128 may rest on the back surface 104 towards the top edge 116 of the cosmetic brush cleaning apparatus 300 and the head of the cosmetic brush 128 may rest towards the bottom edge 118 of the cosmetic brush cleaning apparatus 300. As described above, the height of the elevated wall 124 may be greater at the top edge 116 than the bottom edge 118. Accordingly, the handle of the cosmetic brush 128 may be positioned at a greater distance above the flat support surface than the head of the cosmetic brush 128. Due to the angled configuration relative to the flat support surface, excess water may drain out of the ferrule or head of the cosmetic brush 128. The cosmetic brush may be positioned differently so that the excess water may drain out of the ferrule and the brush head and onto the back surface 104 of the cosmetic brush cleaning apparatus 300. The draining mechanisms 122 disposed on the back surface 104 of the cosmetic brush cleaning apparatus 300 may be used for draining excess water from the back surface 104.

Figure 3F:
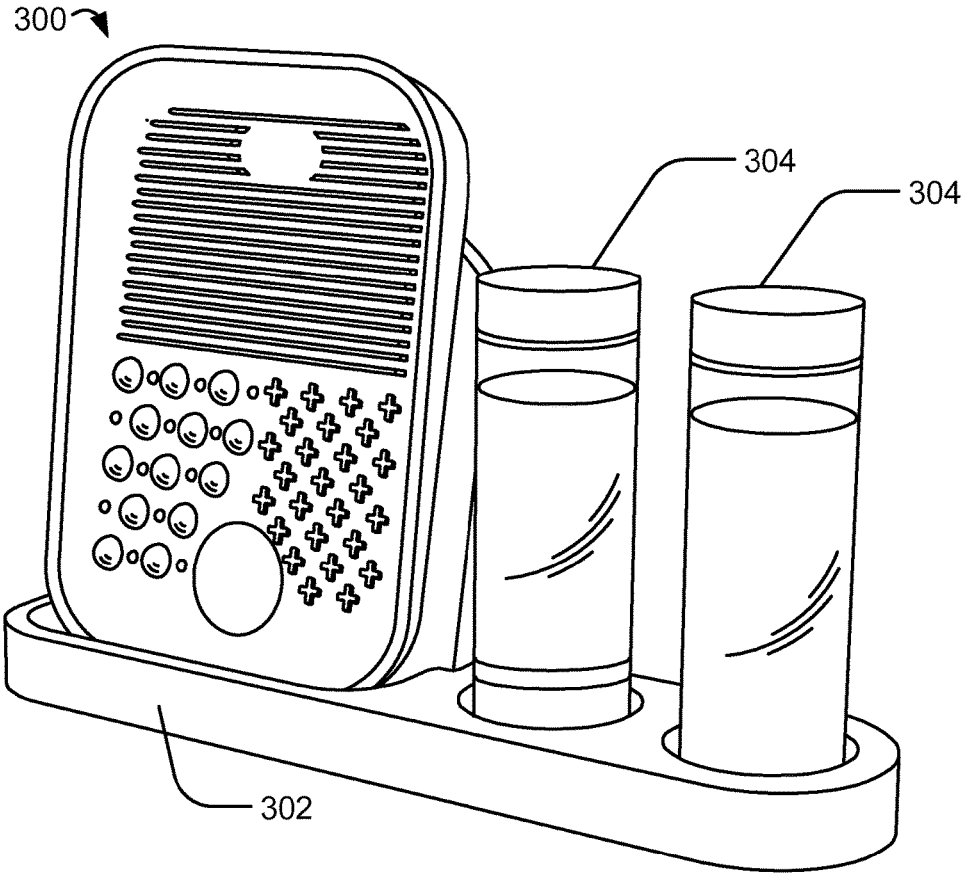
FIG. 3F illustrates an isometric view of a stand storing the example cosmetic brush cleaning apparatus of FIG. 3A.

FIG. 3F illustrates an isometric view of a stand storing the example cosmetic brush cleaning apparatus 300 of FIG. 3A. The stand 302 may have compartments for the storing the cosmetic brush cleaning apparatus 300 and one or more products 304. In some examples, the stand 302 may hold the cosmetic brush cleaning apparatus 300 so that it may drain and dry. The stand 302 may have one or more draining mechanisms to allow excess water to drain from the cosmetic brush cleaning apparatus 300. The stand 302 may further include compartments for storing one or more cosmetic brushes.

Cleaning Methods Using Cosmetic Brush Cleaning Apparatus

Figure 4:
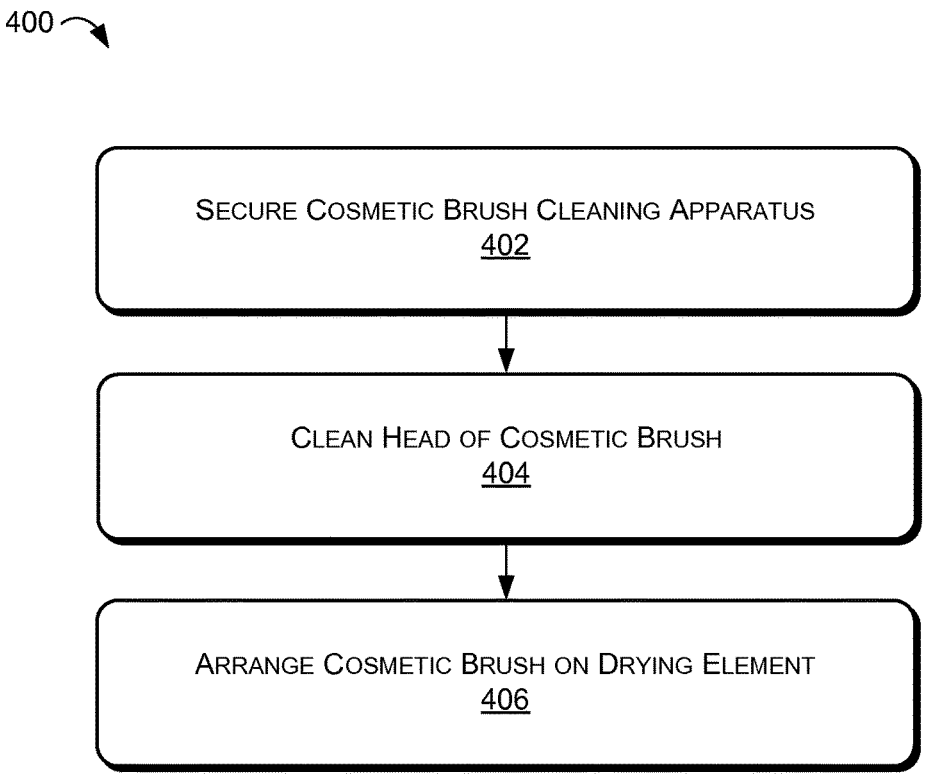
FIG. 4 illustrates an example process for cleaning cosmetic brushes using a cosmetic brush cleaning apparatus.

FIG. 4 illustrates an example process 400 for cleaning cosmetic brushes 128 using the cosmetic brush cleaning apparatus (e.g., cosmetic brush cleaning apparatus 100, cosmetic brush cleaning apparatus 200, and/or cosmetic brush cleaning apparatus 300) described above.

Block 402 illustrates a user securing the cosmetic brush cleaning apparatus (e.g., cosmetic brush cleaning apparatus 100, cosmetic brush cleaning apparatus 200, and/or cosmetic brush cleaning apparatus 300). As described above, at least one example of the cosmetic brush cleaning apparatus (e.g., cosmetic brush cleaning apparatus 100 and/or cosmetic brush cleaning apparatus 200) may include a top sheet 106 and a bottom sheet 108 separated by one or more separators 110. A user may insert his or her hand into an opening created by the one or more separators 110 between the top sheet 106 and the bottom sheet 108 to secure the cosmetic brush cleaning apparatus (e.g., cosmetic brush cleaning apparatus 100 and/or cosmetic brush cleaning apparatus 200). In some examples, the user may insert one or more fingers into finger holes or other grasping and/or holding mechanisms to secure the cosmetic brush cleaning apparatus (e.g., cosmetic brush cleaning apparatus 100, cosmetic brush cleaning apparatus 200, and/or cosmetic brush cleaning apparatus 300). In other examples, the user need not insert his or her hand into an opening. A user may secure the cosmetic brush cleaning apparatus (e.g., cosmetic brush cleaning apparatus 100, cosmetic brush cleaning apparatus 200, and/or cosmetic brush cleaning apparatus 300) by holding on to the cosmetic brush cleaning apparatus in one hand and/or by securing the cosmetic brush cleaning apparatus to a surface as described above.

Block 404 illustrates cleaning a head of a cosmetic brush 128. As described above, a user may apply cleansing product to the cosmetic brush cleaning apparatus (e.g., cosmetic brush cleaning apparatus 100, cosmetic brush cleaning apparatus 200, and/or cosmetic brush cleaning apparatus 300). The user may mix the cleansing product with water and may clean the head of the cosmetic brush 128 by massaging the fibers that make up the head into the elevated cleaning elements 120 on the front surface 102 of the cosmetic brush cleaning apparatus (e.g., cosmetic brush cleaning apparatus 100, cosmetic brush cleaning apparatus 200, and/or cosmetic brush cleaning apparatus 300). The elevated cleaning elements 120 may help draw out makeup, debris, dead skin cells, etc. that is lodged in the fibers of the head of the cosmetic brush. In some examples, the front surface 102 may include draining mechanisms 122 for draining dirty water from the front surface 102. In other examples, the elevated wall 124 may be used to collect water for minimizing the amount of cleansing product used for cleaning multiple cosmetic brushes 128.

Block 406 illustrates arranging the cosmetic brush 128 on a drying element 126. As described above, the drying element 126 may be associated with the elevated wall 124 and/or the back surface 104 of the cosmetic brush cleaning apparatus (e.g., cosmetic brush cleaning apparatus 100, cosmetic brush cleaning apparatus 200, and/or cosmetic brush cleaning apparatus 300). In at least one example, the user may arrange the cosmetic brush 128 on a drying element 126 by inserting a first end of a handle of a cosmetic brush 128 into one of the cutouts in the elevated wall 124 associated with the first side of the cosmetic brush cleaning apparatus (e.g., cosmetic brush cleaning apparatus 100) and inserting a second end of the handle opposite the first end into the corresponding cutout in the second side of the cosmetic brush cleaning apparatus (e.g., cosmetic brush cleaning apparatus 100). The second end of the handle may be opposite the first end and may be associated with the head of the cosmetic brush 128. Any excess water may drip from the head and may be collected on the front surface 102 or may drip into a sink or other collecting mechanism.

In other examples, the user may arrange the cosmetic brush on a drying element 126 associated with the back surface 104 of the cosmetic brush cleaning apparatus (e.g., cosmetic brush cleaning apparatus 200). For instance, the user may place the first end of the handle on an elevated wedge 202 or a plurality of elevated drying elements 204 associated with the an edge of the cosmetic brush cleaning apparatus (e.g., cosmetic brush cleaning apparatus 200) and the second end of the handle may lie on an opposite edge of the cosmetic brush cleaning apparatus (e.g., cosmetic brush cleaning apparatus 200). As a result of such placement, the cosmetic brush 128 may be arranged in an angular position relative to the back surface 104 so that excess water may drain from the head of the cosmetic brush 128 onto the back surface 104 of the cosmetic brush cleaning apparatus (e.g., cosmetic brush cleaning apparatus 200) or some other collecting mechanism.

In some examples, the cosmetic brush cleaning apparatus (e.g., cosmetic brush cleaning apparatus 300) may be arranged so that the back surface 104 of the cosmetic brush cleaning apparatus (e.g., cosmetic brush cleaning apparatus 300) forms an acute angle with a flat support surface as a result of the gradually declining elevated wall 124 height from the top edge 116 to the bottom edge 118. The first end of the handle may be set towards the top edge 116 of the cosmetic brush cleaning apparatus (e.g., cosmetic brush cleaning apparatus 300) and the second end of the handle that is associated with the head of the cosmetic brush 128 may be set towards the bottom edge 118 of the cosmetic brush cleaning apparatus (e.g., cosmetic brush cleaning apparatus 300). The top edge 116 may be elevated to a height greater than the bottom edge 118. As a result, the cosmetic brush 128 may be arranged on the back surface 104 of the cosmetic brush cleaning apparatus (e.g., cosmetic brush cleaning apparatus 300) so that the excess water may drain from the head of the cosmetic brush 128 onto the back surface 104 of the cosmetic brush cleaning apparatus (e.g., cosmetic brush cleaning apparatus 300) or some other collecting mechanism.

Figure 5:
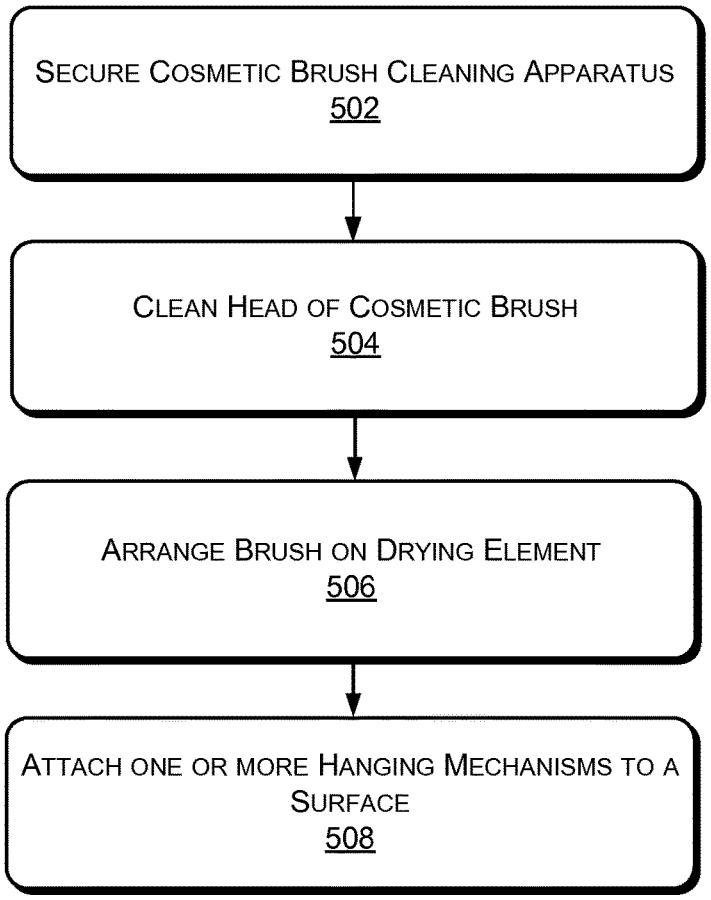
FIG. 5 illustrates an example process for cleaning and hanging cosmetic brushes using the cosmetic brush cleaning apparatus.

FIG. 5 illustrates an example process 500 for cleaning and hanging cosmetic brushes 128 using a cosmetic brush cleaning apparatus (e.g., cosmetic brush cleaning apparatus 100, cosmetic brush cleaning apparatus 200, and/or cosmetic brush cleaning apparatus 300) described above.

Block 502 illustrates a user securing the cosmetic brush cleaning apparatus (e.g., cosmetic brush cleaning apparatus 100, cosmetic brush cleaning apparatus 200, and/or cosmetic brush cleaning apparatus 300). As described above, at least one example of the cosmetic brush cleaning apparatus (e.g., cosmetic brush cleaning apparatus 100 and/or cosmetic brush cleaning apparatus 200) may include a top sheet 106 and a bottom sheet 108 separated by one or more separators 110. A user may insert his or her hand into an opening created by the one or more separators 110 interposed between the top sheet 106 and the bottom sheet 108 to secure the cosmetic brush cleaning apparatus (e.g., cosmetic brush cleaning apparatus 100 and/or cosmetic brush cleaning apparatus 200). In some examples, the user may insert one or more fingers into finger holes or other grasping and/or holding mechanisms to secure the cosmetic brush cleaning apparatus (e.g., cosmetic brush cleaning apparatus 100, cosmetic brush cleaning apparatus 200, and/or cosmetic brush cleaning apparatus 300). In other examples, the user need not insert his or her hand into an opening. A user may secure the cosmetic brush cleaning apparatus (e.g., cosmetic brush cleaning apparatus 100, cosmetic brush cleaning apparatus 200, and/or cosmetic brush cleaning apparatus 300) by holding on to the cosmetic brush cleaning apparatus (e.g., cosmetic brush cleaning apparatus 100, cosmetic brush cleaning apparatus 200, and/or cosmetic brush cleaning apparatus 300) in one hand and/or by securing the cosmetic brush cleaning apparatus (e.g., cosmetic brush cleaning apparatus 100, cosmetic brush cleaning apparatus 200, and/or cosmetic brush cleaning apparatus 300) to a surface as described above.

Block 504 illustrates cleaning a head of a cosmetic brush 128. As described above, a user may apply cleansing product to the cosmetic brush cleaning apparatus (e.g., cosmetic brush cleaning apparatus 100, cosmetic brush cleaning apparatus 200, and/or cosmetic brush cleaning apparatus 300). The user may mix the cleansing product with water and may clean the head of the cosmetic brush 128 by massaging the fibers that make up the head into the elevated cleaning elements 120 on the front surface 102 of the cosmetic brush cleaning apparatus (e.g., cosmetic brush cleaning apparatus 100, cosmetic brush cleaning apparatus 200, and/or cosmetic brush cleaning apparatus 300). The elevated cleaning elements 120 may help draw out makeup, debris, dead skin cells, etc. that is lodged in the fibers of the head of the cosmetic brush 128. In some examples, the front surface 102 may include draining mechanisms 122 for draining dirty water from the front surface 102. In other examples, the elevated wall 124 may be used to collect water for minimizing the amount of cleansing product used for cleaning multiple cosmetic brushes 128.

Block 506 illustrates arranging the cosmetic brush on a drying element such as the cutouts cut out of the elevated wall 124, the elevated wedge 202 disposed on the back surface 104, or the elevated drying elements 204 disposed on the back surface 104, as described above.

Block 508 illustrates attaching one or more hanging mechanisms 130 to a surface for drying the cosmetic brush 128. The cosmetic brush cleaning apparatus (e.g., cosmetic brush cleaning apparatus 100, cosmetic brush cleaning apparatus 200, and/or cosmetic brush cleaning apparatus 300) may include one or more hanging mechanisms 130 for attaching the cosmetic brush cleaning apparatus (e.g., cosmetic brush cleaning apparatus 100, cosmetic brush cleaning apparatus 200, and/or cosmetic brush cleaning apparatus 300) to another surface. The cosmetic brush cleaning apparatus (e.g., cosmetic brush cleaning apparatus 100, cosmetic brush cleaning apparatus 200, and/or cosmetic brush cleaning apparatus 300) may hang from the hanging mechanisms 130 so that the heads of the cosmetic brushes 128 hang toward the ground and water retained in the fibers of the heads can drip away from the heads of the cosmetic brushes 128.

CONCLUSION

Although several embodiments have been described in language specific to structural features and/or methodological acts, it is to be understood that the claims are not necessarily limited to the specific features or acts described. Rather, the specific features and acts are disclosed as illustrative forms of implementing the claimed subject matter.

What is claimed is:

1. An apparatus for cleaning and drying cosmetic brushes, the apparatus comprising:

a front surface including a plurality of spaced apart elevated cleaning elements, each cleaning element having a base attached to the front surface, and a top that is elevated from the front surface, wherein the base of each cleaning element is spaced apart from the base of adjacent cleaning elements, the front surface including an elevated wall that protrudes from the front surface and follows a contour around an entirety of the front surface;

a back surface coupled to the front surface, the back surface facing an opposite direction from the front surface; and one or more drying elements disposed on the back surface or the elevated wall, the one or more drying elements configured to hold substantially linear handles of cosmetic brushes in an angled position over the apparatus, with a first end of the brush higher than a second end of the brush.

2. The apparatus of claim 1, wherein the elevated cleaning elements comprise one or more of a plurality of elevated cross shapes, a plurality of elevated circular shapes, or a plurality of elevated rectangular shapes.

3. The apparatus of claim 1, wherein the elevated wall is elevated to a height relative to the front surface greater than a height that the plurality of elevated cleaning elements is elevated relative to the front surface.

4. The apparatus of claim 1, wherein the back surface is coupled to and separated from the front surface by one or more separators that are interposed between the front surface and the back surface, the one or more separators following a contour of the front surface and the back surface.

5. The apparatus of claim 1, further comprising a plurality of draining mechanisms disposed on the front surface or the back surface, the plurality of draining mechanisms configured to drain water from the apparatus.

6. The apparatus of claim 1, wherein:

the one or more drying elements are disposed on the back surface and comprise one or more elevated drying elements; and the one or more elevated drying elements are arranged at least along the contour of an edge of the back surface.

7. The apparatus of claim 1, further comprising one or more hanging mechanisms coupled to the back surface, the one or more hanging mechanisms configured for attaching the apparatus to a surface for drying and storing one or more cosmetic brushes.

8. The apparatus of claim 1, wherein the front surface is associated with a front side of a sheet and the back surface is associated with a back side of the sheet, the back side of the sheet opposite the front side.

9. The apparatus of claim 8, wherein:

a top height of the elevated wall above the front surface at a top edge of the front surface is taller than a bottom height of the elevated wall above the front surface at a bottom edge of the front surface, the bottom edge opposite the top edge; and a side height of the elevated wall above the front surface along a first edge and a second edge gradually decreases from the top height to the bottom height, the first edge and the second edge being substantially parallel, and the first edge and the second edge being substantially perpendicular to the top edge and the bottom edge.

10. An apparatus for cleaning and drying cosmetic brushes, the apparatus comprising:

a front surface including a plurality of elevated cleaning elements that are elevated from the front surface and an elevated wall that protrudes from the front surface and follows a contour around an entirety of the front surface;

a back surface coupled to the front surface, the back surface opposite the front surface;

one or more drying elements disposed on the elevated wall;

wherein the one or more drying elements comprise a plurality of circular cutouts in a first portion of the elevated wall associated with a first edge of the apparatus and a plurality of circular cutouts in a second portion of the elevated wall associated with a second edge of the apparatus, the first edge opposite the second edge; and wherein individual circular cutouts of the plurality of circular cutouts in the first potion have a corresponding individual circular cutout of the plurality of circular cutouts in the second portion such that corresponding individual circular cutouts are configured to secure a cosmetic brush.

11. A cosmetic brush cleaning apparatus comprising:

a body comprising:

a top sheet including a plurality of elevated cleaning elements that are elevated from a surface of the top sheet and an elevated wall that follows a contour of the top sheet;

a bottom sheet coupled to the top sheet, the bottom sheet opposite the top sheet; and one or more separators connecting the top sheet and the bottom sheet, the one or more separators following the contour of a portion of the top sheet, the one or more separators connecting the top and bottom sheets along at least a portion of an outer perimeter of the top and back sheets; and one or more drying elements disposed on the body.

12. The cosmetic brush cleaning apparatus of claim 11, wherein the body comprises a flexible, non-water absorbent material.

13. The cosmetic brush cleaning apparatus of claim 11, wherein the top sheet further includes a plurality of draining mechanisms configured to drain water from the top sheet.

14. The cosmetic brush cleaning apparatus of claim 11, wherein:

the one or more drying elements comprise a plurality of circular cutouts in a first portion of the elevated wall associated with a first edge of the body and a plurality of circular cutouts in a second portion of the elevated wall associated with a second edge of the body, the first edge opposite the second edge; and individual circular cutouts of the plurality of circular cutouts in the first potion having a corresponding individual circular cutout of the plurality of circular cutouts in the second portion such that corresponding individual circular cutouts are configured to secure a cosmetic brush at a distance above the top sheet.

15. The cosmetic brush cleaning apparatus of claim 11, further including one or more hanging mechanisms coupled to the bottom sheet, the one or more hanging mechanisms configured to hang the body from another surface for drying or storing one or more cosmetic brushes that are secured in the one or more drying elements.

16. The cosmetic brush cleaning apparatus of claim 11, wherein the bottom sheet includes a plurality of draining mechanisms configured to drain water from the bottom sheet, the plurality of draining mechanisms comprising cutouts in the bottom sheet.

17. The cosmetic brush cleaning apparatus of claim 11, wherein the one or more drying elements are disposed on the back surface.

18. The cosmetic brush cleaning apparatus of claim 17, wherein the one or more drying elements comprise an elevated wedge associated with a first edge of the back surface, the elevated wedge configured to elevate a handle of a cosmetic brush to a height above a head of the cosmetic brush resting on a second edge of the back surface, the second edge opposite the first edge.

19. The cosmetic brush cleaning apparatus of claim 17, wherein the one or more drying elements comprise a plurality of elevated drying elements arranged along a first edge of the back surface and a second edge of the back surface, the second edge opposite the first edge, the plurality of elevated drying elements configured to elevate handles of cosmetic brushes to heights above heads of the cosmetic brushes.

* * * * *